US012193544B2

(12) United States Patent
Giovale et al.

(10) Patent No.: US 12,193,544 B2
(45) Date of Patent: Jan. 14, 2025

(54) FOOTWEAR ACCESSORY BINDING SYSTEM

(71) Applicant: KAHTOOLA, INC., Flagstaff, AZ (US)

(72) Inventors: Daniel Giovale, Flagstaff, AZ (US); Christopher Bunch, Flagstaff, AZ (US)

(73) Assignee: KAHTOOLA, INC., Flagstaff, AZ (US)

( * ) Notice: Subject to any disclaimer, the term of this patent is extended or adjusted under 35 U.S.C. 154(b) by 0 days.

(21) Appl. No.: 16/200,151

(22) Filed: Nov. 26, 2018

(65) Prior Publication Data

US 2019/0090590 A1 Mar. 28, 2019

Related U.S. Application Data

(63) Continuation of application No. 13/743,104, filed on Jan. 16, 2013, now Pat. No. 10,136,702.

(60) Provisional application No. 61/586,909, filed on Jan. 16, 2012.

(51) Int. Cl.

| | |
|---|---|
| ***A43C 15/02*** | (2006.01) |
| ***A43C 15/06*** | (2006.01) |
| ***A44B 11/22*** | (2006.01) |

(52) U.S. Cl.

CPC ..... *A43C 15/02* (2013.01); *A43C 15/063* (2013.01); *A43C 15/066* (2013.01); *A44B 11/22* (2013.01); *Y10T 24/406* (2015.01)

(58) Field of Classification Search

CPC .. A43B 3/26; A43B 5/18; A43C 15/02; A43C 15/06; A43C 15/061; A43C 15/063; A43C 15/065; A43C 15/066; A43C 15/068; A43C 15/09

See application file for complete search history.

(56) References Cited

U.S. PATENT DOCUMENTS

| | | | | | |
|---|---|---|---|---|---|
| 710,187 | A | | 9/1902 | Downer | |
| 757,240 | A | | 4/1904 | Spacie | |
| 958,984 | A | * | 5/1910 | Waldstein | A43C 15/063 36/7.7 |
| 1,070,951 | A | * | 8/1913 | Elliott | A43C 15/06 36/7.6 |
| 1,219,688 | A | * | 3/1917 | Anderson | A43C 15/06 36/7.6 |
| 1,224,217 | A | * | 5/1917 | Schefstrom | A43C 15/06 36/7.6 |
| 1,995,975 | A | | 3/1935 | Fleschutz | |
| 2,002,706 | A | * | 5/1935 | Mong | A43C 15/06 36/7.6 |
| 2,361,972 | A | * | 11/1944 | Smith | A43C 15/063 36/62 |
| 2,382,821 | A | | 8/1945 | Rosenthal | |
| 2,489,289 | A | * | 11/1949 | Oscar | A43C 15/06 36/7.7 |
| 2,648,112 | A | | 8/1953 | Neumann | |
| 2,668,373 | A | * | 2/1954 | Russo | A43B 5/18 36/7.6 |

(Continued)

*Primary Examiner* — Megan E Lynch

(74) *Attorney, Agent, or Firm* — Ballard Spahr LLP

(57) ABSTRACT

An improved binding for footwear traction devices, snowshoes and other footwear accessories that provides adjustable lateral supports and generally even platform or foot bed. Furthermore, an improved traction device with removable rear traction component to allow for use with detachable snowshoe platform.

20 Claims, 23 Drawing Sheets

(56) References Cited

U.S. PATENT DOCUMENTS 2,888,754 A * 6/1959 Miller ..... A43C 15/02 36/7.7
3,685,173 A * 8/1972 Piazza ..... A43C 15/068 36/7.6
3,786,579 A * 1/1974 Clark ..... A43C 15/068 36/7.6
3,821,858 A 7/1974 Haselden
4,302,890 A * 12/1981 Covell ..... A43C 15/06 36/62
4,480,396 A 11/1984 Lowe
4,928,407 A 5/1990 Ottieri
4,955,149 A 9/1990 Ottieri
4,967,492 A 11/1990 Rosen
4,969,278 A 11/1990 Ottieri
4,998,358 A 3/1991 Girardelli
5,239,702 A 8/1993 Itoth
5,241,762 A 9/1993 Rosen
5,493,794 A 2/1996 McKenzie
5,791,070 A 8/1998 Gallay
5,794,362 A 8/1998 Polk
5,867,922 A * 2/1999 Hull ..... A43B 5/18 36/116
5,901,471 A * 5/1999 Warner ..... A43C 15/068 36/124
5,950,334 A * 9/1999 Gerhardt ..... A43B 5/18 36/59 R
6,414,835 B1 7/2002 Wolf et al.
6,742,286 B2 * 6/2004 Giovale ..... A43C 15/061 36/62
6,814,360 B2 * 11/2004 Kiniry ..... A43C 15/06 280/11.3
7,661,207 B2 2/2010 Monsees
7,716,855 B2 * 5/2010 Gallay ..... A63C 13/001 36/122
2002/0095820 A1 * 7/2002 Giovale ..... A43C 15/061 36/7.6
2002/0178611 A1 * 12/2002 Farys ..... A43B 13/10 36/7.6
2003/0037461 A1 * 2/2003 Petzl ..... A43C 15/068 36/7.6
2003/0061740 A1 * 4/2003 Dodge ..... A43C 15/061 36/122
2004/0016145 A1 * 1/2004 Skrivan ..... A43C 15/068 36/7.6
2004/0148802 A1 * 8/2004 Soriano ..... A43C 15/068 36/66
2004/0194346 A1 * 10/2004 Petzl ..... A43C 15/068 36/59 R
2004/0231200 A1 * 11/2004 Forrest ..... A63C 13/02 36/122
2005/0183291 A1 * 8/2005 Kiniry ..... A63C 13/001 36/122
2008/0060225 A1 3/2008 Kilgore
2008/0244933 A1 * 10/2008 Giovale ..... A43C 15/063 36/116
2008/0263902 A1 * 10/2008 Chartrand ..... A63C 13/005 36/122
2011/0047826 A1 3/2011 Rosen
2011/0083343 A1 4/2011 Helmut
2011/0173845 A1 * 7/2011 Faber ..... A63C 13/006 36/125
2011/0258878 A1 * 10/2011 Jones ..... A43C 15/063 36/62

* cited by examiner

FOOTWEAR ACCESSORY BINDING SYSTEM

CROSS-REFERENCE TO RELATED APPLICATIONS

This application claims priority to U.S. provisional patent application Ser. No. 61/586,909, filed on Jan. 16, 2012, entitled "IMPROVED BINDING SYSTEM FOR USE ON CRAMPONS, SNOWSHOES AND OTHER FOOTWEAR ACCESSORIES," which is hereby incorporated by reference in its entirety for all references.

FIELD OF DISCLOSURE

The present disclosure relates generally to a binding system for aiding in the attachment of footwear accessories, such as crampons or snowshoes, to various types of footwear.

BACKGROUND OF THE INVENTION

Crampons, Snowshoes, and other accessories worn over footwear require some way to connect the footwear to the crampon, snowshoe, or other accessory. The problem of fitting a large variety of different sized and shaped footwear items to a given accessory has led to a proliferation of design solutions over centuries.

More specifically, in modern times, there have been many mechanical types of solutions to connecting the footwear to the accessory such as a boot equipped with a feature that is fitted in one of many ways with a receiving structure on the accessory such that the two are mated securely during the use of the accessory. A typical Alpine ski boot and binding is an example of this. Another example is a step-in crampon where the boot is generally rigid and has features for mating with the crampon toe bale and rear bale with locking mechanism and strap currently very common for such an application.

For common types of footwear that do not have any special features designed to mate with a footwear accessory, the accessory might employ a different strategy for securing the accessory to the footwear. In this case, many various strap configurations, molded plastic and elastomeric components to surround the footwear have been developed. Generally, these solutions are designed to accommodate a variety of sizes and shapes of footwear by having flexible materials and adjustable straps to allow for these variations.

In demanding applications where the footwear accessory is, for example, a snowshoe where significant forces during use encourage movement between the footwear and the snowshoe and can result in shifting of the footwear in the snowshoe binding. This shifting often results in decreased performance and enjoyment in the activity and can result in the snowshoe needing constant adjustment or coming detached from the footwear completely.

SUMMARY OF THE INVENTION

In accordance with various embodiments, a footwear accessory binding is disclosed. The footwear accessory binding can be a crampon system adaptable to different widths of footwear. The crampon system can be configured to use with different footwear accessories, such as a snow shoe or crampon. The crampon system of the present disclosure can be used to as part of a crampon and a snowshoe.

The crampon can comprise a base plate having a substantially rigid horizontal platform; a first adjustable support having a substantially horizontal platform; and a second adjustable support having a substantially horizontal platform, wherein the base plate and the first adjustable support are rotatably connected, wherein the base plate and the second adjustable support are rotatably connected, wherein the base plate and the first adjustable support are releasably connected, wherein the base plate and the second adjustable support are releasably connected, wherein the first adjustable support or the second adjustable support are able to move relative to the base plate upon release of a fastener. In various embodiment, the substantially horizontal platform of the first adjustable support and the substantially horizontal platform of the second adjustable support can be in the substantially the same plane or not overlapping.

A front binding can comprise the base plate, the first adjustable support, and the second adjustable support. The front binding can be adaptable for use a crampon. The front binding can be adaptable for use with a snow shoe.

The crampon system can comprise a base plate having a substantially rigid horizontal platform with a first base plate pivot, a second base plate pivot, a first base plate attachment, and a second base plate attachment. The first base plate pivot and the second base plate pivot can be closer to a front portion of the base plate than the first base plate attachment and the second base plate attachment. The crampon system can further comprise a first adjustable support having a substantially horizontal platform with a first adjustable support pivot and a first adjustable support attachment. The first adjustable support pivot can be closer to a front portion of the first adjustable support than the first adjustable support attachment. The crampon system can further comprise a second adjustable support having a substantially horizontal platform with a second adjustable support pivot and a second adjustable support attachment. The second adjustable support pivot can be closer to a front portion of the second adjustable support than the second adjustable support attachment. The first base plate pivot and the first adjustable support pivot can be rotatably connected. The second base plate pivot and the second adjustable support pivot can be rotatably connected. The first base plate attachment and the first adjustable support attachment can be releasably connected. The second base plate attachment and the second adjustable support attachment can be releasably connected, wherein the first adjustable support and the second adjustable support are configured to move relative to the base plate by removing a fastener from the first base plate attachment and the second base plate attachment respectively.

At least one of the first adjustable support and the second adjustable support can include an upwardly extending sidewall. The sidewall can be configured to contact sides of the footwear. In various embodiments, the sidewalls are spaced apart a distance, and as the first adjustable support or the second adjustable support are moved relative to the base plate, the distance between the sidewalls changes.

The base plate further comprises a front support protruding upwardly from a forward portion of the base plate, wherein the front support is configured to facilitate retaining the front of the footwear. If appropriate for the desired use, the base plate can also comprise a plurality of traction cleats that protrude from the bottom side of the base plate.

In various embodiment, the base plate and at least one of the first adjustable support and the second adjustable support include an intermediate attachment, wherein the intermediate attachment is configured to limit the degree of rotation movement of the adjustable support to which it is connected.

The intermediate attachment can also restrict movement in a vertical direction and in a front to back direction with respect to the base plate.

In various embodiments, the sidewalls are spaced apart a distance, and as the first adjustable support or the second adjustable support are moved relative to the base plate, the distance between the sidewalls changes. In various embodiments, at least one of the first base plate attachment the second base plate attachment, the first adjustable support attachment and the second adjustable support attachment can comprise a plurality of fastening points with each fastening point being at a different location, allowing adjustment between the first base plate attachment, the second base plate attachment and at least one of the first adjustable support attachment and the second adjustable support attachment to be fixed in a plurality of locations. The lateral supports, e.g., a sidewall, and the substantially horizontal platform of the first adjustable support and the lateral supports and the substantially horizontal platform of the second adjustable support can have a plurality of protrusions which are configured to contact a bottom and side of the footwear respectively and reduce movement of the footwear.

The crampon system can further comprise a rear binding that is releasably connected to a front binding comprising the base plate, the first adjustable support and the second adjustable support. The front binding can be adapted to remain securely attached to the footwear when the rear binding is detached from the footwear. The rear binding can comprise a rear base plate with an adjustable length extender bar releasably connected to the front base plate, such as with a hook which removably engages a bent tab on the bottom of the front base plate. The front base plate can comprise a stabilizing element(s) through which the extender bar can extend and serve to restrict movement of the extender bar. The rear binding can also comprise a rear support and a rear strap having a buckle. The rear strap and the buckle can be configured to restrain the footwear to the rear binding. The front binding can also comprise a front binding rear strap and a buckle. The buckle can adapted to secure the front binding rear strap and be quickly buckled and released. The front binding rear strap can include a plurality of strap holes for adjustability.

The adjustable buckle can comprise a front binding rear strap and an adjustable strap buckle; the adjustable strap buckle adapted to secure adjustable strap having multiple holes therein, the buckle comprising a first closed end adapted to attach to an anchor, a second end which includes a side-accessible opening configured to allow adjustable strap to access the opening from the side and pass through the side opening; a tooth element between the first and the second end, said tooth element projecting in a direction toward the second end, wherein the tooth is adapted to engage and secure one of the said multiple holes in the adjustable strap.

The buckle can comprise a slotted hole on a first end of the quick buckle, a restraining arm on a second end of the buckle, an opening between one end of the restraining arm and a frame defining the slotted hole, and a protrusion extending from the frame defining the slotted hole toward the restraining arm. The slotted hole can be adapted to attach to an anchor on a rear portion of the front binding and the opening is configured to allow the front binding rear strap to pass through the opening on the side of the buckle and engage one of the plurality of strap holes over the protrusion while receiving pressure on the front binding rear strap from the restraining arm causing one of the plurality of strap holes to maintain engagement with the protrusion.

BRIEF DESCRIPTION OF THE DRAWINGS

The drawings described herein are for illustration purposes only and are not intended to limit the scope of the present disclosure in any way. The present disclosure will become more fully understood from the detailed description and the accompanying drawings wherein.

DETAILED DESCRIPTION

Figure 1:
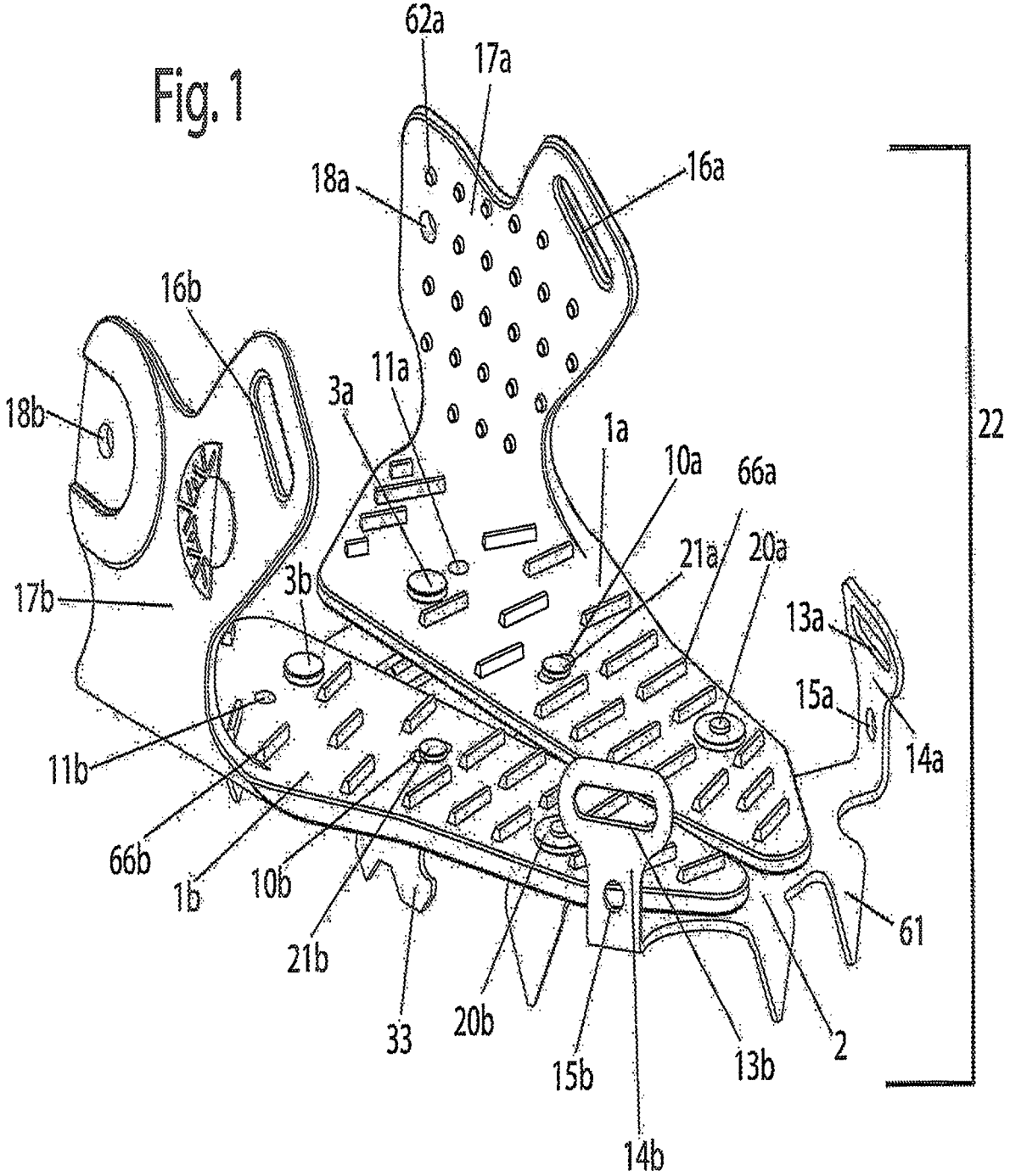
FIG. 1 is a top isometric view of traction component with straps and buckles removed for clarity, in accordance with various embodiments.
Figure 2:
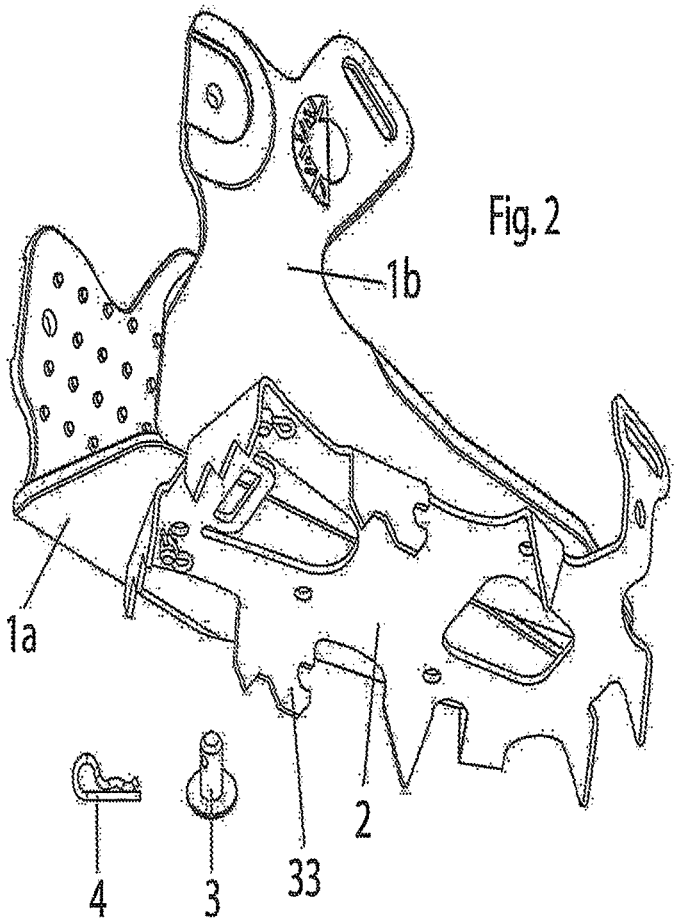
FIG. 2 is a bottom isometric view of traction component with straps and buckles removed for clarity, in accordance with various embodiments.
Figure 3:
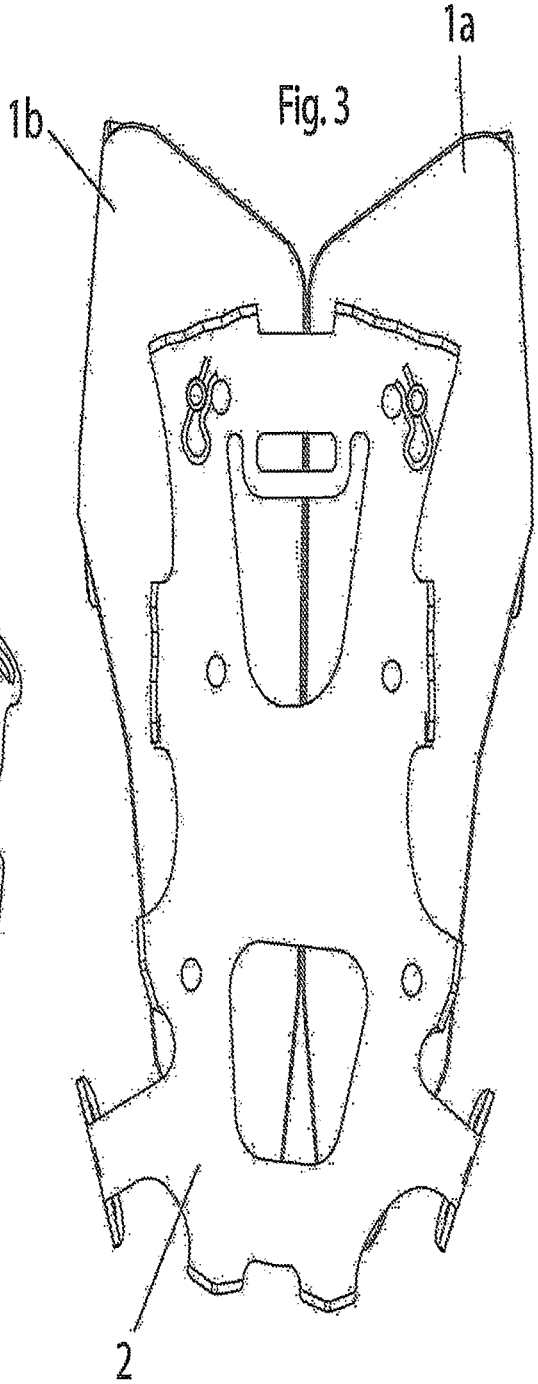
FIG. 3 is a bottom view of traction component with straps and buckles removed for clarity, in accordance with various embodiments.

The detailed description of exemplary embodiments herein makes reference to the accompanying drawings, which show exemplary embodiments by way of illustration and its best mode. While these exemplary embodiments are described in sufficient detail to enable those skilled in the art to practice the invention, it should be understood that other embodiments can be realized and that logical, chemical and mechanical changes can be made without departing from the spirit and scope of the invention. Thus, the detailed description herein is presented for purposes of illustration only and not of limitation. For example, the steps recited in any of the method or process descriptions can be executed in any order and are not necessarily limited to the order presented. Moreover, many of the functions or steps can be outsourced to or performed by one or more third parties. Furthermore, any reference to singular includes plural embodiments, and any reference to more than one component or step can include a singular embodiment or step. Also, any reference to attached, fixed, connected or the like can include permanent, removable, temporary, partial, full and/or any other possible attachment option, unless specifically stated. Additionally, any reference to without contact (or similar phrases) can also include reduced contact or minimal contact.

In various embodiments, the present disclosure provides for a footwear accessory binding system that has attributes of improved performance where the footwear is held securely relative to a footwear accessory coupled thereto. While specific attention herein is given to crampons and snowshoes as footwear accessories, footwear accessory binding system can also be applicable to a variety of other footwear accessories including but not limited to skis, roller skates, inline skates, and so on. So while the various described embodiments can be focused on crampons and/or snowshoes, a person of ordinary skill in the art can apply the elements described as part of the various embodiments of the crampons and/or snowshoes to any other known or developed footwear accessories.

To increase the degree of lateral support provided by a binding system, whereby improving a wearer's stability, a binding can be constructed with rigid lateral supports. ("Rigid," as used in the context of the lateral support includes semi-rigid or any other degree of rigidity sufficient to withstand the forces encountered during use of a footwear accessory as intended but sufficiently bendable that it gives way to a sufficient degree to provide comfort to the wearer.) With such lateral supports, combined with a simple strap system and front supports to capture footwear, it is possible to create a secure binding that limits the amount of shifting between the accessory and the footwear allowing the footwear to stay securely in place. However, limitations arise with rigid lateral supports. For example, bindings constructed with a one piece accessory component that provides rigid lateral supports generally should match the width of the footwear to be used. Such a product is not easily marketable because it will only fit properly on footwear of one width due to the lateral supports dimension for that specific type and size of footwear, requiring a degree of customization to the binding or the footwear.

In accordance with an aspect of the present disclosure, a described binding system can accommodate multiple dimensions of footwear in a manner that makes use rigid lateral supports feasible. Adjustable lateral supports, configured to accommodate multiple widths, are useful for situations in which a footwear accessory can be fitted onto or over a wearer's footwear or, if applicable, a foot. A requisite degree of rigidity in the adjustable lateral support is useful to maintain stability between the footwear and the footwear accessory, particularly in instances where the activity performed in the footwear accessory causes an increase in various lateral, torsional, or vertical forces on the wearer's lower leg. Such forces give rise to the need for added security of the binding system in order for the footwear accessory to stay securely in place.

In accordance with another aspect of the disclosure, a binding system can be configured to provide dual purposes. A binding can have a front binding portion that can be used independently for a first purpose, and then the binding can be attached to a rear binding portion for a second purpose. For example, in an embodiment, binding system can be incorporated into a crampon and be adapted for use as both a crampon and as a snowshoe crampon adapted to mate with a snowshoe platform.

While the footwear accessory binding systems described herein can be applicable to most footwear or even a wearer's foot, the greatest benefit is for a system for primarily non-specialized footwear. Non-specialized footwear does not need to be purchased specifically to work with a particular binding system. Whereas, a specialized piece of footwear can be, for example, a ski boot that functions specifically with a ski binding. Examples of common types of footwear that can be used with embodiments described herein include running shoes, hiking boots, snow boots, snowboarding boots, dress shoes, sandals, and the like. As used herein, "footwear" will refer to common footwear and not specialized footwear.

Embodiments described herein provide for added security by configuring the lateral supports to adjust to substantially match the width of the footwear used. In various embodiments, components of the binding system can be adjusted to different positions which allow for the selective adjustment of the lateral supports to accommodate different sizes of footwear. Binding systems can be adapted to be incrementally or continuously adjustable. When fitted, the adjustable lateral supports along with any number of strap systems, buckles, and enhancements can hold the footwear generally stationary relative to the binding system during demanding uses.

For purposes of adjustability, in accordance with various embodiments, a binding system can comprise a base structural component (e.g., a base plate), a first adjustable support, and a second support, which is optionally a second adjustable support. The first and/or second supports can be repositioned relative to the base component. In an embodiment, each of the first and/or second supports can be rotatably adjusted relative to the base plate. For example, one or both can comprise a rotatable attachment (also referred to herein as a first adjustable support pivot and second adjustable support pivot) and be rotatably attached to the base plate. The rotatable attachment can be located on a front portion, a rear portion, or a location therebetween of the respective support. By rotating the first support and/or the second support, either toward the other support or away from the other support relative to the base plate, the desired fit can be achieved for the wearer's footwear. Once the desired fit is achieved, a second attachment that releasable connects the base plate to the support can lock the components into position. The second attachment can comprise a releasable fastener.

The base structural component can be any structural feature to which the first and second supports can attach. The base structural component can comprise attachments to which the first and second supports can slideably, rotatably, or releasably engage, as is appropriate for a particular attachment. The base structural component can further provide a base of support to the first and second adjustable supports, e.g., as a base plate. For example, the base plate can have a substantially rigid horizontal platform and have a length and a width that is sufficient to provide base support to the first and second support. ("Rigid" as used herein in the context of the base plate means a material that does not readily bend with the forces encountered by a horizontal platform during a particular application, such as snow shoeing or ice hiking.) Furthermore, base plate can comprise a strong, durable material such as steel (e.g., stainless steel), aluminum, titanium, or other suitable materials.

In various embodiments, as previously stated, one or both of the first and second supports can be rotated. The rotation can occur about an attachment that couples to a base plate to a support. The rotatable attachment can be located closer to the forward edge of the support than to the rear edge. In addition, the rotatable attachment can be located closer to the outer edge than the inner edge of the support, or closer to the outer edge than the center of the support. In an embodiment, the rotatable attachment is located on the support a distance from the forward-most edge, this distance being at least 15% of the length as measured between the forward-most edge and the opposite point on the rear edge.

Once the desired rotational adjustment is made, the adjustable support can be locked into position with the use of a releasable fastener (A "fastener" as used herein is any mechanism to attach at least two components. Various fasteners can be permanent or releasable, moveable (rotatable or slideable) or generally immovable). The releasable fastener can be located closer to the rear of the adjustable support than to the forward edge. In other embodiments, the orientation of the pivot can be reversed, i.e., location of the rotatable attachment can be closer to the rear than the front and the releasable fastener can be closer to the front edge.

In addition to the above described attachments, a binding system can optionally comprise a slideable attachment. The slideable attachment can be located on the support somewhere between or intermediate to (not necessarily aligned with) the rotatable attachment and the releasable attachment. The slideable attachment can provide a slot that limits the range of rotation that is permitted for one or both of the adjustable supports. For example, the slideable attachment can define an arced path of a chosen distance to limit the degree of rotation. Furthermore, the slideable attachment can be adapted to restrict movement in the front and back direction and vertical direction.

First adjustable support and second support (or optionally second adjustable support) can comprise a substantially horizontal platform, and can further comprise a lateral support. Lateral support can comprise a structural component which upwardly extends from the horizontal platform at or near the outer edge and, in addition, can be at or near the rear portion, if appropriate. Lateral support can comprise a continuous span of material or alternatively discontinuous span of material, for example a frame-like or lattice-like structure. In various embodiments, lateral support can comprise a sidewall and/or a strap(s). In various embodiments, the lateral support can be generally vertical or alternatively, slightly curved, angled generally inward, and/or angled generally outward.

The first and second supports are arranged in a manner to provide a foot bed that is generally even or generally horizontal. For example, the platform of the first support is in substantially the same plane as the platform of the second support, and such plane can be generally horizontal. Stated differently, both the bottom surfaces of the first and second supports directly contact the base structural component and do not overlap with one another throughout the range of available widths.

The first and second supports can comprise any suitable material. The horizontal platform can be a rigid or semi-rigid material, such as a moderately hard plastic, hard plastic, or a metal. In an embodiment, where a significant portion of the horizontal platform abuts a base plate, the material of the horizontal platform need not be as rigid as it need be otherwise. In various embodiments, the lateral support can be rigid and as mentioned previously, the support can be sufficiently bendable so that it can yield slightly during use to provide some comfort to the wearer, if appropriate, such as for a sidewall. In the same or different embodiments, the lateral support can be flexible, such as for a strap. As discussed above the lateral support can be utilized to reduce the footwear accessory increased lateral, torsional, or vertical forces on the wearer's lower leg. As such, in many embodiments, a rigid or semi-rigid lateral support can be beneficial. In accordance with various embodiments, the binding system can provide substantially rigid lateral supports which facilitate holding the footwear securely in place.

Optionally, the inner surfaces of the first and second supports can comprise surface features or coatings which improve the ability to frictionally engage the footwear. For example, the inner surface can comprise protrusions to restrict a forward and/or backward motion of the footwear.

In various embodiments, additional supporting elements at a location forward from the lateral supports can be provided. For example, the base plate can comprise upwardly extending front support(s). Such embodiments can require that the forward portion of the base plate be slightly wider than the combined width of the first and second supports at their forward portions so that a front support(s) can extend upward from the base plate. The front supports can facilitate retaining the front portion of the footwear. As the base structural component does not move during a width adjustment, the front support(s) location and particularly its angle remain constant.

With regard to the releasable attachment, any suitable releasable fastener can be utilized to securely fix the position of the first and second adjustable supports. For example, a releasable fastener can comprise a pin and a retaining clip wherein the pin can extend into a hole or slot of either or both the support and base plate and a clip can lock the pin into place. A plurality of holes can be located in the first support, the second support, and/or the base plate, and the holes can be arranged in a manner such that holes on the support align with the holes on the base plate as the supports are moved. Once the holes are aligned for the desired width, a pin can extend into the hole and then be held with a clip. Thus, moving the first support and the second support together or apart relative to the base plate allows for multiple positions to accommodate different widths of footwear. Other suitable fasteners include machine screws used in conjunction with threaded holes and/or nuts, push button release pins (e.g., spring loaded push button release pins), quarter-turn style fasteners, keyed through-shape fasteners (e.g., fasteners that insert in a keyed fashion and are turned so that they cannot be removed unless turned back to the correct alignment), various styles of releasable rivets, clamps, various locking snap-type fasteners, and the like.

In accordance with various embodiments, a slot can be used in place of a hole to allow the first support, the second support, and/or the base plate to slide continuously when fasteners are released so to adjust the width of the first support and/or the second support relative to one another and/or relative to the base plate. The fasteners can then be appropriately engaged to secure the supports in a fixed location relative to the base plate. In accordance with various embodiments, it is possible to combine slots and holes in various combinations to achieve the adjustability. For example, by loosening the component of a fastener from the hole, the support and base plate can move relative to one another by floating in the slot. The slot can define the extent that the support and base plate can move relative to one another. By tightening the fastener, the support and the base plate can be restrained relative to one another. The slot can also comprise peaks and valleys around the slot configured such that attaching the fastener through the slot and through a corresponding hole can allow the fastener to be constrained in a valley neighboring peaks and fix the support relative to the base plate at a particular width size.

In another example of the various devices or components that can be used as attachments, permanent pins can function as holes. For example instead of a hole a threaded pin (internal or external) can be pressed into the desired location on either the support or the base plate. The pin can pass through a corresponding hole or slot on the corresponding element (e.g. the support or the base plate). By sizing the pin correctly the pin can be used to fixedly attach the support or the base plate together with no movement. Or by sizing the pin correctly the pin can be used as a pivot point or a guide without fixedly attaching the support or the base plate together.

In another example, a rotatable attachment or the intermediate slideable attachment can comprise a rivet-type fastener. A properly sized rivet holding two features together can allow one feature to pivot relative to the other feature or allow one feature to move along the groove of the other without separating the features.

The various fasteners described herein are only examples. Any fastener known in the art can be substituted, provided the functionality of the binding system is not changed from the various embodiments and examples disclosed herein.

In accordance with various embodiments, the binding system can further comprise a first traction component that is adapted to be attached to common footwear. The binding system can facilitate securing the traction component to the footwear so that the footwear (combined with the traction component) can engage with the terrain in a different manner. For example, the first traction component can be the entire crampon or a part thereof. The crampon can comprise cleats and/or teeth. In another example, the first traction component can be the entire snowshoe or a part thereof. In accordance with such an example, the binding system and more particularly the first traction component of the binding system can be releasably attached to a snowshoe platform via a step-in mechanism or the like. In another example, the first traction component can be the entire roller/inline skate or a part thereof. This concept can be utilized by any footwear accessory.

In accordance with various embodiments, the binding system can comprise a plurality of traction components. For example, the binding system can comprise a first traction component and a second traction component. In the situation in which the binding system applies to a crampon device, the first traction component can be a front traction cleat and the second traction component can be a rear traction cleat. The front traction cleat and the rear traction cleat can be connected by an extender bar. In various embodiments, the extender bar can be adjustable, otherwise referred to as an adjustable length extender bar. The rear traction cleat can be engaged and held laterally and/or vertically in place by running an extender bar through a slot on the front traction cleat. A hook on the extender bar can hook over the slot on the front traction cleat. By securing the hook in the slot and rotating the extender bar and rear traction assembly into place using approximately a quarter of a turn the front traction cleat and the rear traction cleat can be suitably connected for use. The rear traction cleat can be secured against the rear of the footwear outsole and locked into position, further restricting relative movement with a strap(s) and/or upward extending supports that can be engaged over the footwear to hold it into position against the footwear.

In accordance with various embodiments, a binding system can be secured with a buckle. The buckle can secure a strap and allow for adjustability. The buckle can be adapted for efficient and quick securement and release of the strap. The strap can comprise multiple holes therein for adjustability. The buckle can comprise a first closed end adapted to attach to an anchor, a second end which includes a side opening or an opening with side-access configured to allow adjustable strap to access the opening second end by way of the side opening and pass through the second end; a tooth element(s) (e.g., a rigid protrusion) between the first and the second end, said tooth element projecting in a direction to facilitate secure engagement with the strap, e.g., toward the second end. As such, the tooth is adapted (e.g., compositionally, structurally, and/or directionally) to engage and secure one of the said multiple holes in the adjustable strap.

In accordance with various embodiments, the crampon binding system can be used in conjunction with a snowshoe platform. In an embodiment in which a rear traction cleat is utilized in the crampon, the snowshoe platform could receive damage. Specifically, the rear traction cleats of the crampon can interfere with the snowshoe platform due to the sharp points impacting the platform. To limit the damage to the snowshoe platform, in various embodiments, a crampon binding system can comprise a removable rear traction cleat. By removing a rear strap, that forces the rear traction cleat forward against the footwear, and rotating the rear traction cleat until it freely releases, the wearer can quickly and easily remove the rear traction cleat and stow it away for later use. The crampon system is thus able to mate with the snowshoe platform without the rear traction cleats presence, thus avoiding damage to the platform.

Figure 13:
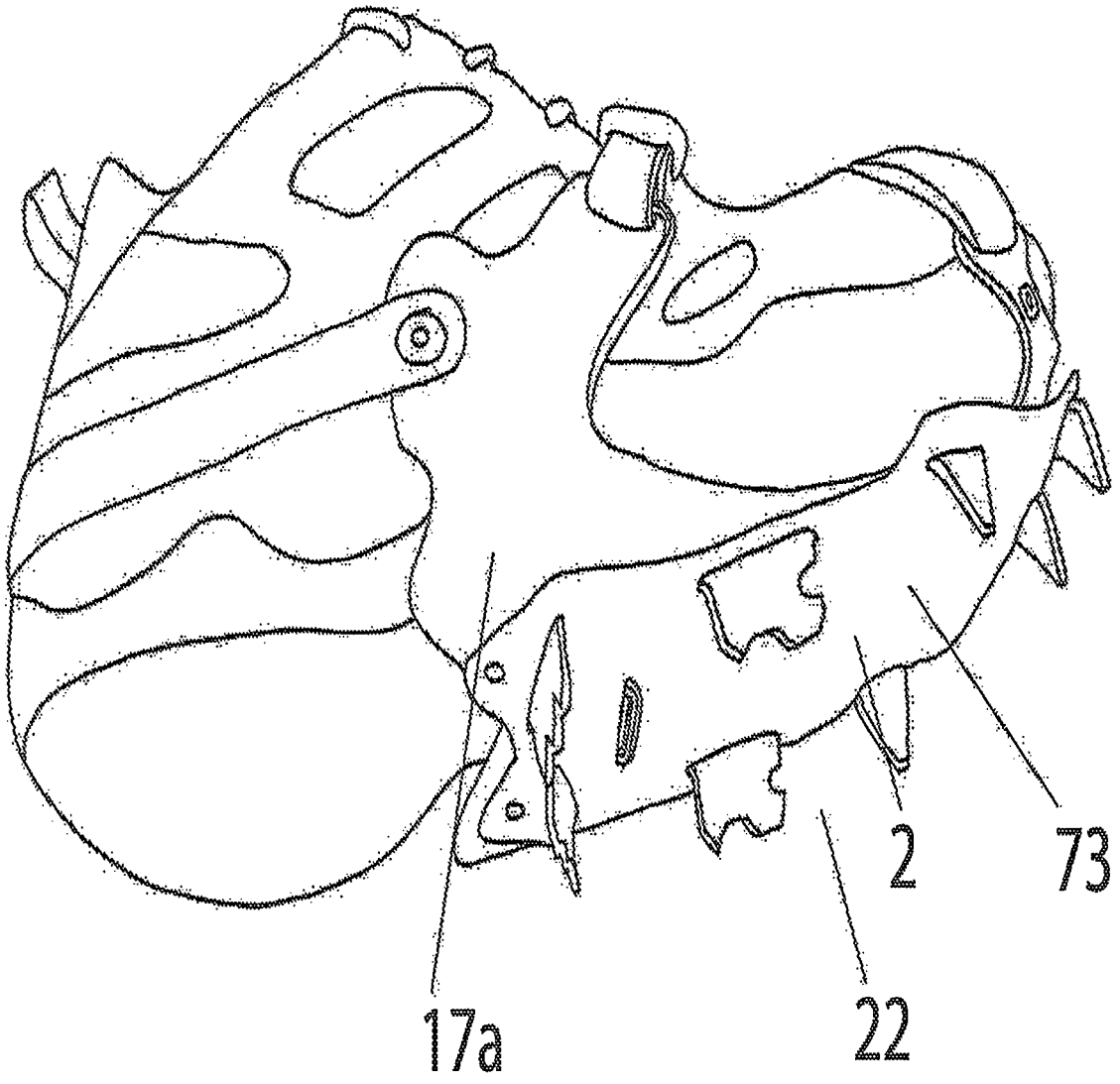
FIG. 13 is a bottom isometric view of traction component fitted to a narrow shoe, in accordance with various embodiments.
Figure 14:
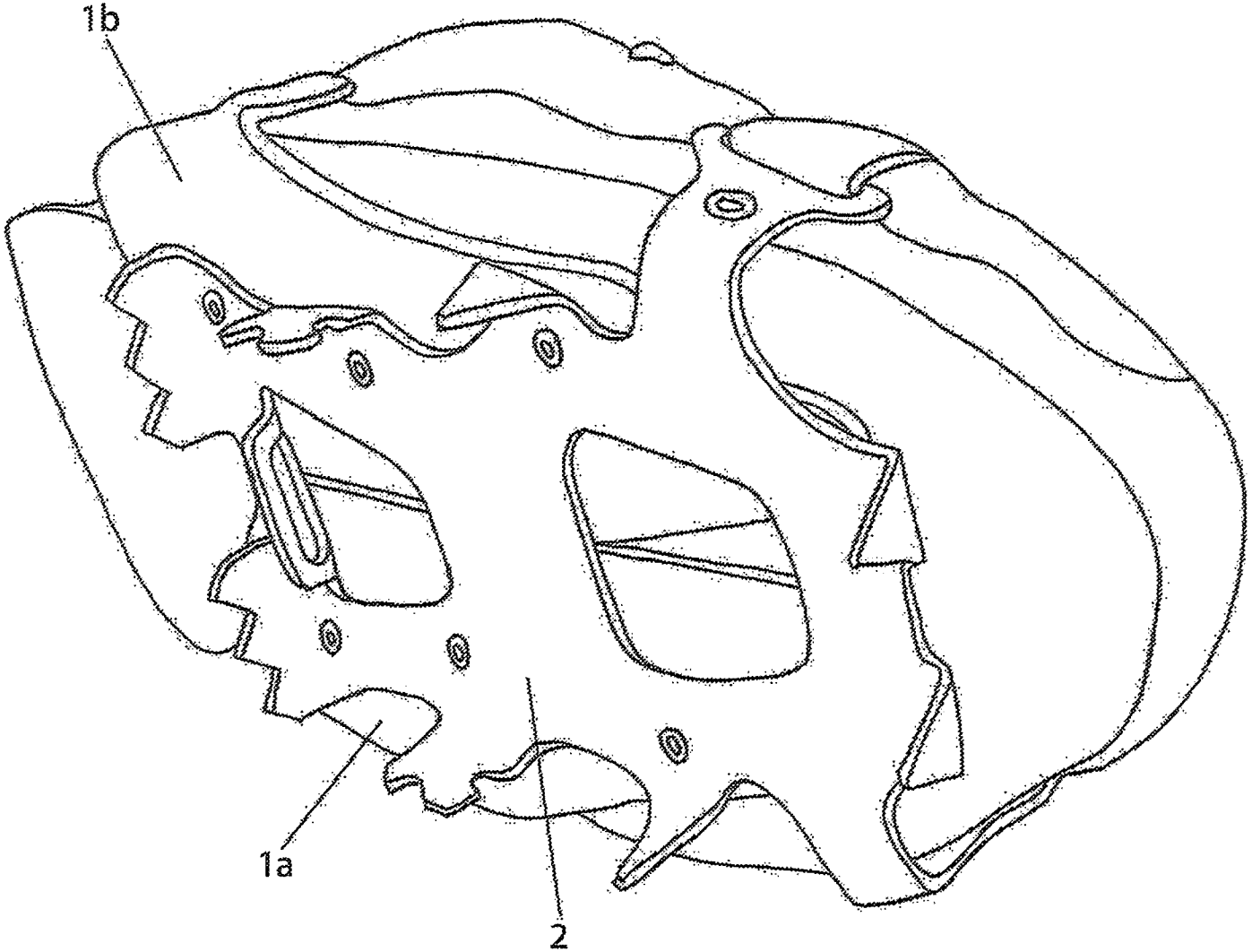
FIG. 14 is a bottom isometric view of traction component fitted to a narrow shoe, in accordance with various embodiments.
Figure 15:
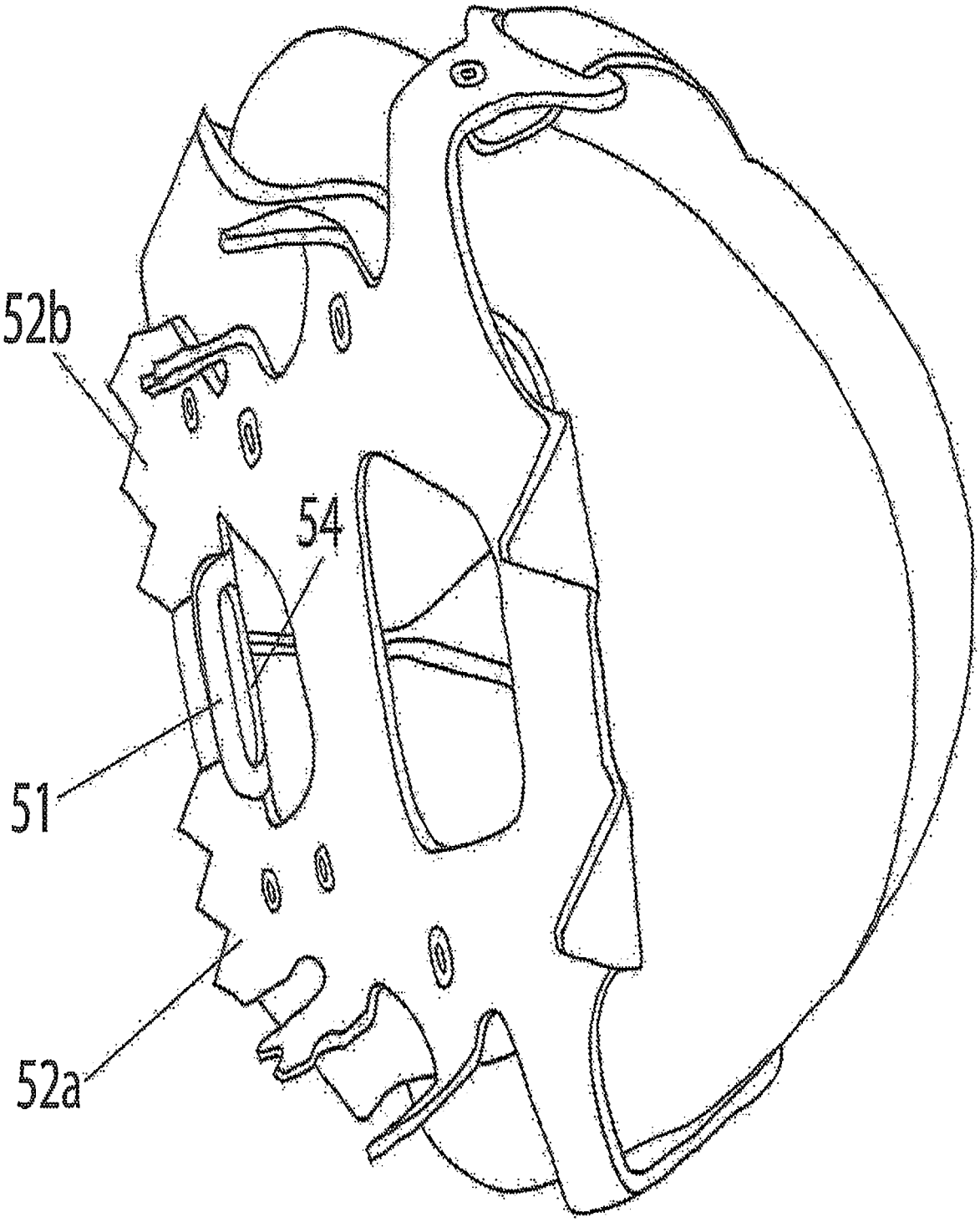
FIG. 15 is a bottom isometric view of traction component fitted to a narrow shoe, in accordance with various embodiments.
Figure 16:
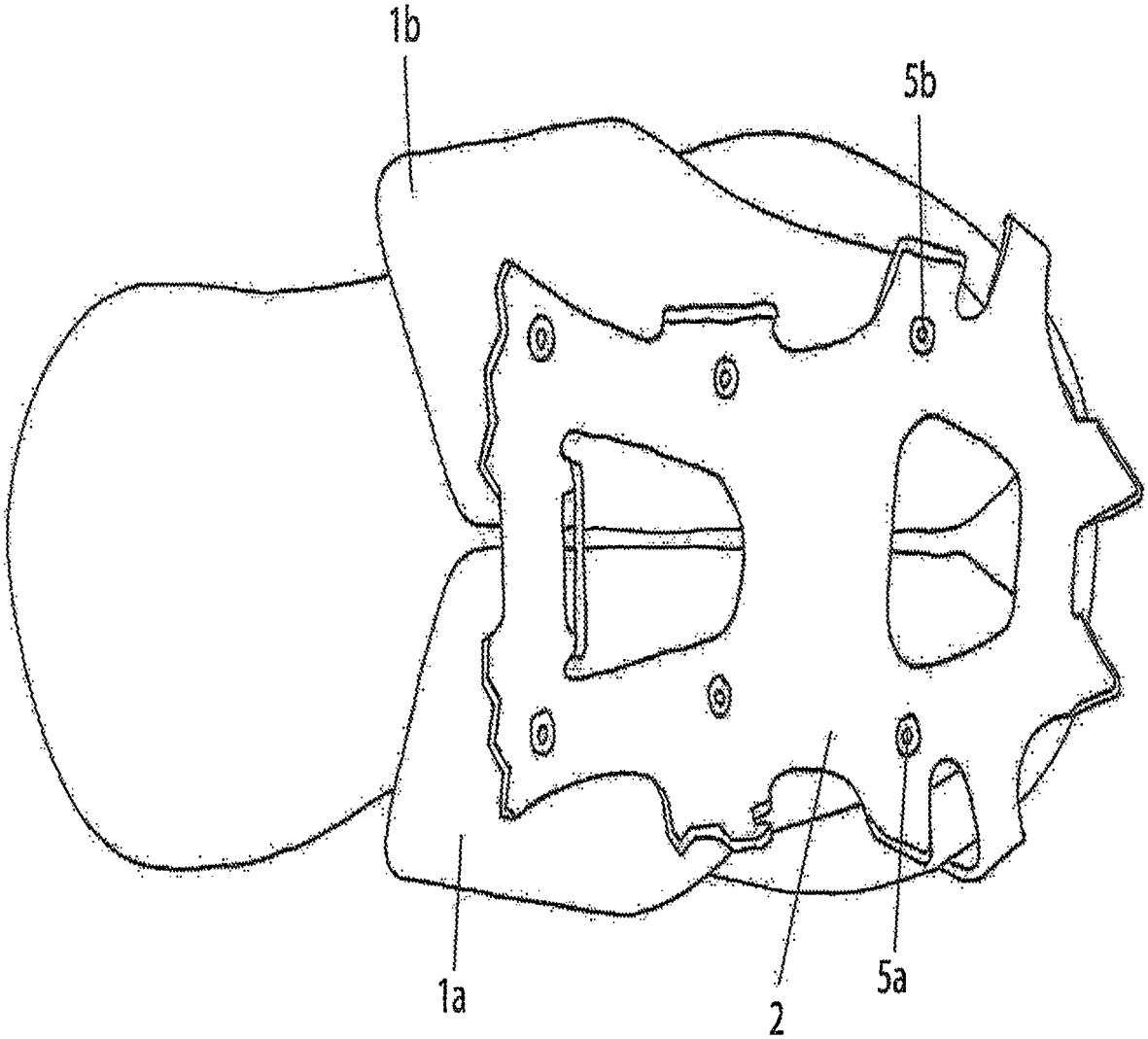
FIG. 16 is a bottom view of traction component fitted to a narrow shoe, in accordance with various embodiments.

In accordance with various embodiments, as illustrated in FIGS. 1 and 13, a footwear accessory binding system (as illustrated, a crampon binding system) can comprise a front binding 22. The front binding 22 can comprise a base plate 2, a first adjustable support 17*a*, and a second adjustable support 17*b*. In various embodiments, a footwear accessory binding system can comprise a rear binding 24. In various embodiments, as illustrated in FIGS. 18-21, a footwear accessory binding system can comprise a front binding 22 and a rear binding 24.

Figure 27:
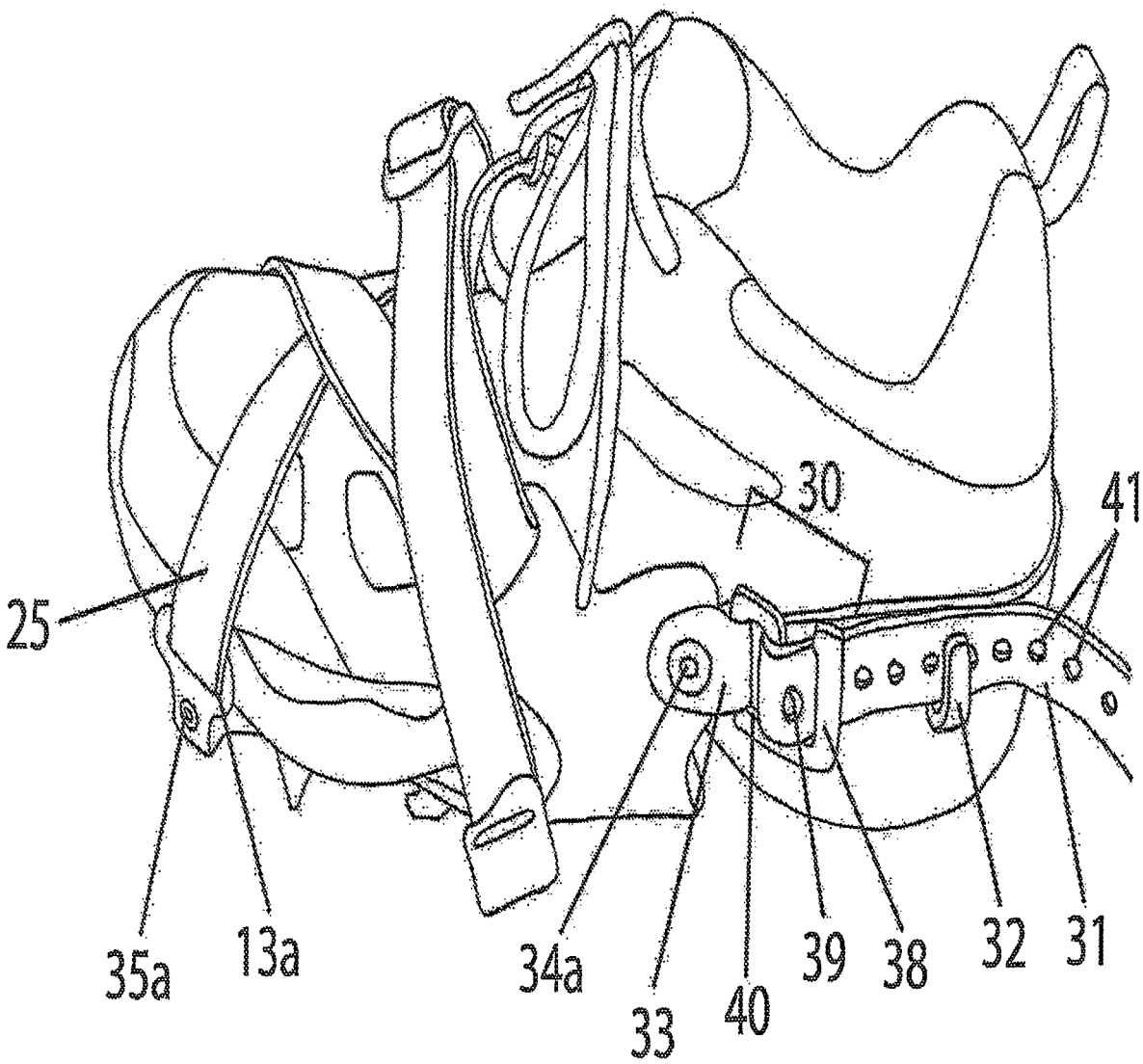
FIG. 27 is side rear view of traction component including rear buckle fully threaded with rear strap, in accordance with various embodiments.
Figure 28:
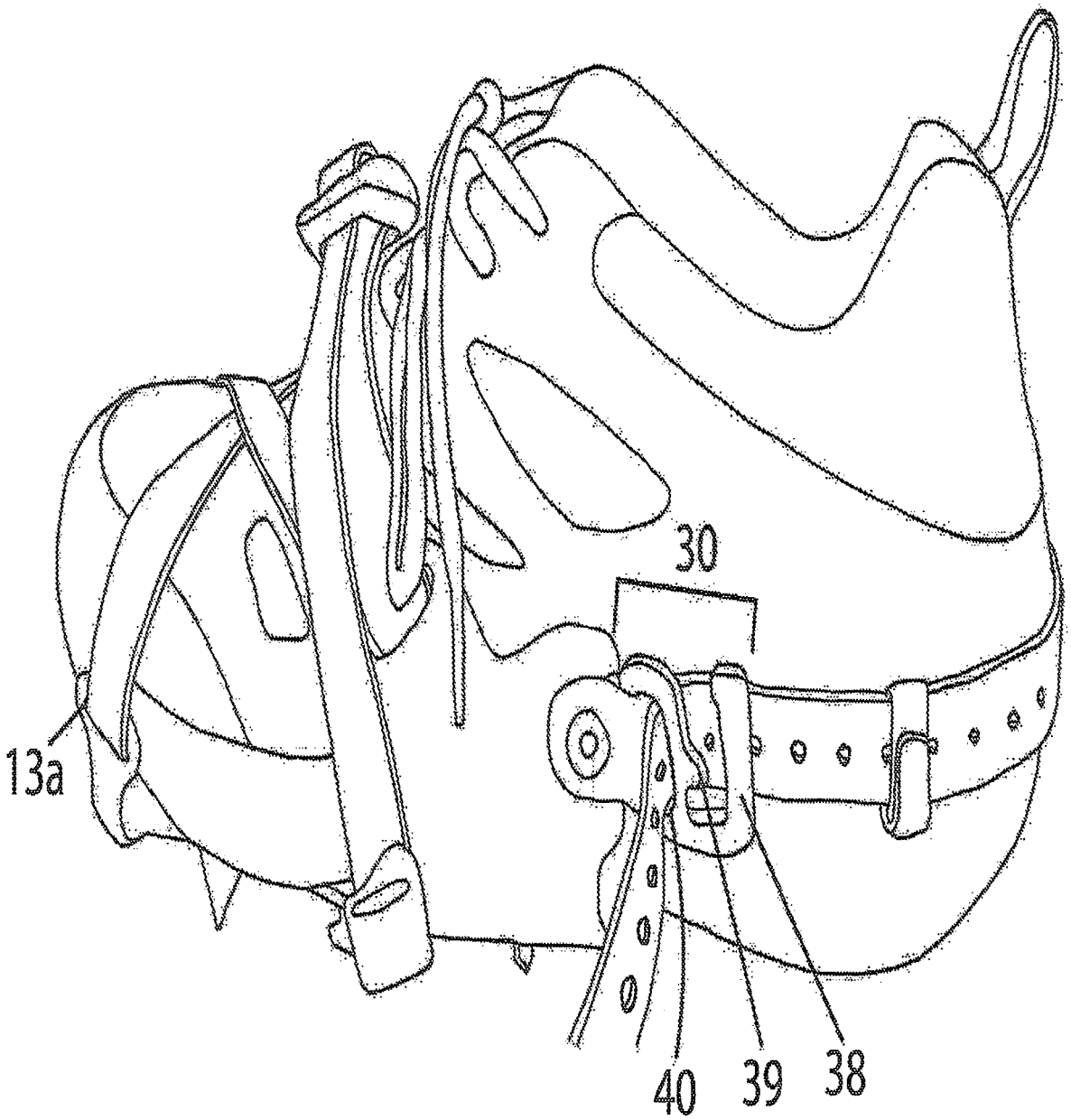
FIG. 28 is side rear view of traction component including rear buckle partially threaded with rear strap, in accordance with various embodiments.
Figure 29:
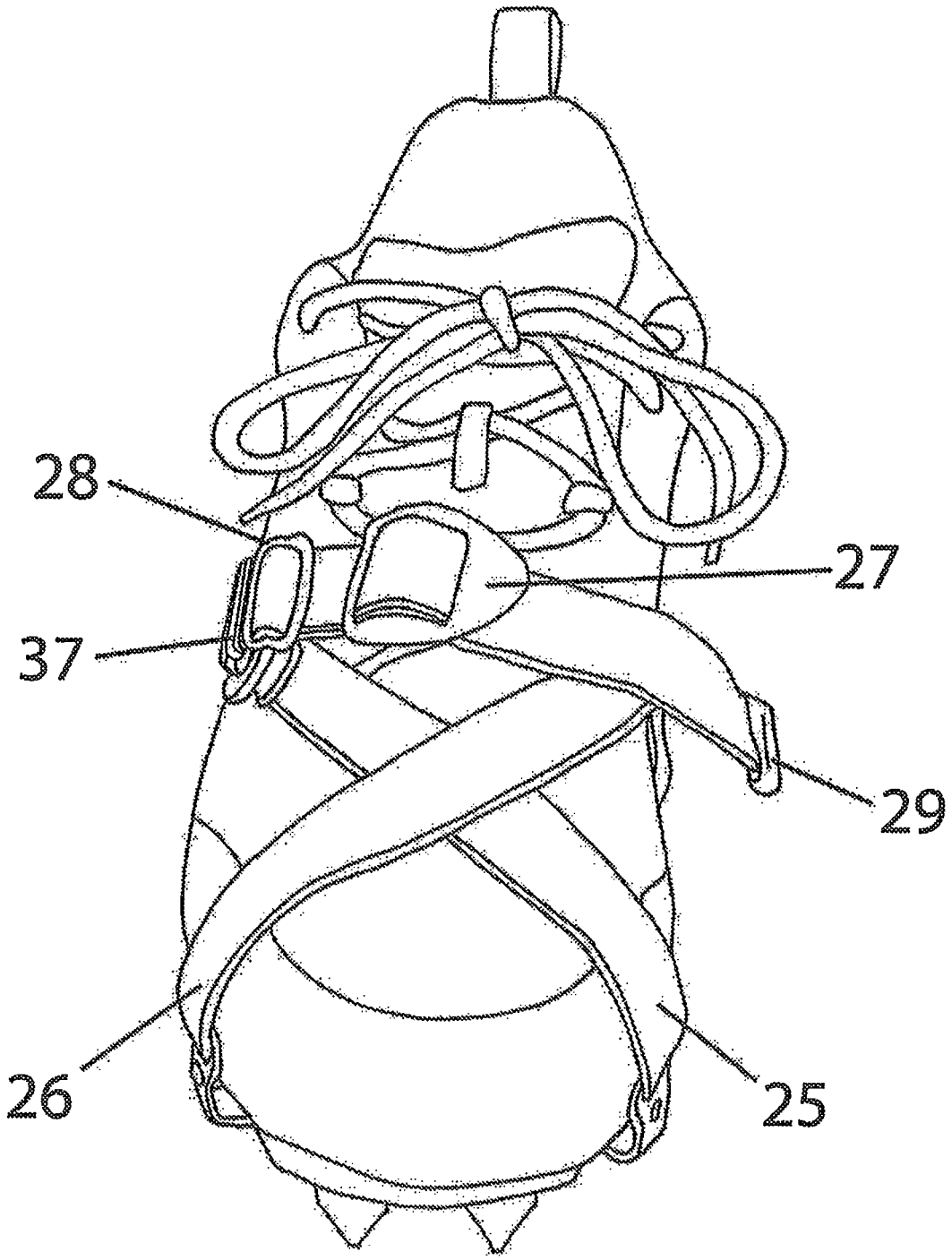
FIG. 29 is a top front view of traction component, in accordance with various embodiments.

In various embodiments, base plate 2 can be configured to attach to a traction device as discussed above, or base plate 2 can be a part of a traction device. As illustrated in FIGS. 1-17 and 19-29, base plate 2 can comprise a plurality of cleats 61 for a crampon device. However, as discussed above and with regard to various embodiments, base plate 2 can be a part of or configured to attach to any of a variety of footwear accessories. In various embodiments, as illustrated in FIG. 1, base plate 2 can comprise front support 14*a* and front support 14*b*. Front support 14*a* and front support 14*b* can further include slot 13*a* and slot 13*b* which are configured to receive straps. For example, FIGS. 27 and 29 illustrate a front strap 25 lacing through slot 13*a*. FIG. 29 illustrates front strap 26 lacing through slot 13*b*. Front support 14*a* and front support 14*b* can further include hole 15*a* and hole 15*b*. Holes 15*a* and 15*b* are rivet holes to attach the straps to their respective posts. The straps are woven through the slots 13*a* and 13*b*, then are riveted to the holes 15*a* and 15*b* via a hole that is in the end of the straps.

In various embodiments, as illustrated in FIGS. 1-17 and 19-29, the first adjustable support 1*a* and/or the second adjustable support 1*b* can be configured to move relative to base plate 2 to be adjustable to the width of the footwear being used. For example, the bottom of adjustable support 1*a* can abut the top of base plate 2. The bottom of adjustable support 1*b* can abut the top of base plate 2. In various embodiments, adjustable support 1*a* and adjustable support 1*b* can comprise substantially horizontal platforms or foot beds (the top surface of adjustable support 1*a* and adjustable support 1*b*). The horizontal foot bed of adjustable support 1*a* and the horizontal foot bed of adjustable support 1*b* can be in substantially the same plane. Such a configuration provides the same base support to the outer edge of footwear as the interior of footwear. In accordance with various embodiments, adjustable support 1*b* and adjustable support 1*a* can not overlap one another at any available adjusted position. In various embodiments, as a result of being on substantially the same plane, adjustable support 1*b* and adjustable support 1*a* can interfere with each other when rotated in a certain manner for a certain distance in either direction with respect to base plate 2. To avoid any interference, a slideable intermediate attachment 21*a* and 21*b* is provided to restrict the degree of rotation.

In various embodiments, adjustable support 1*a* and adjustable support 1*b* can comprise lateral supports 17*a* and 17*b*. In various examples, the lateral supports can include upwardly extending structural elements. In various examples, the lateral supports can be a side wall. As shown in FIG. 1, lateral supports 17*a* and 17*b* can have protrusions 62*a* and 62*b* (not shown) on the surface of the lateral supports 17*a* and 17*b* which faces toward the footwear. The horizontal foot bed of adjustable support 1*a* and the horizontal foot bed of adjustable support 1*b* can have protrusions 66*a* and 66*b* on the surface of the horizontal foot bed of adjustable support 1*a* and the horizontal foot bed of adjustable support 1*b*. Lateral supports 17*a* and 17*b* can have an anchor receiving hole 18*a* and 18*b* located on the rear portion of lateral supports 17*a* and 17*b*. Lateral supports 17*a* and 17*b* can have a strap receiving slot 16*a* and 16*b* respectively on the front portion of the lateral supports 17*a* and 17*b*.

Figure 4:
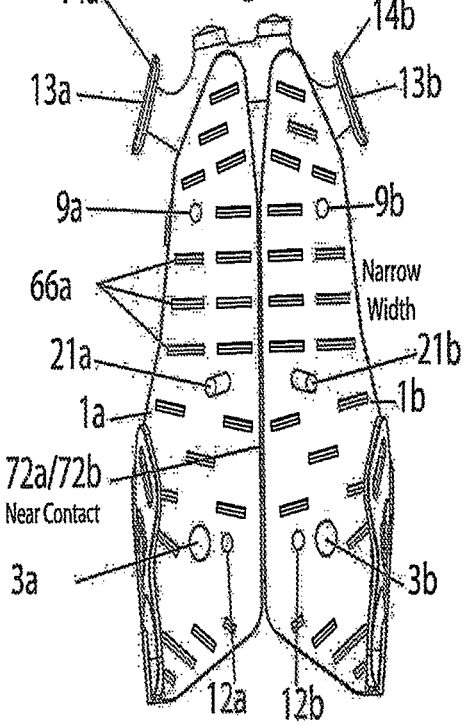
FIG. 4 is a top view of traction component in position 1 with straps and buckles removed for clarity, in accordance with various embodiments.
Figure 6:
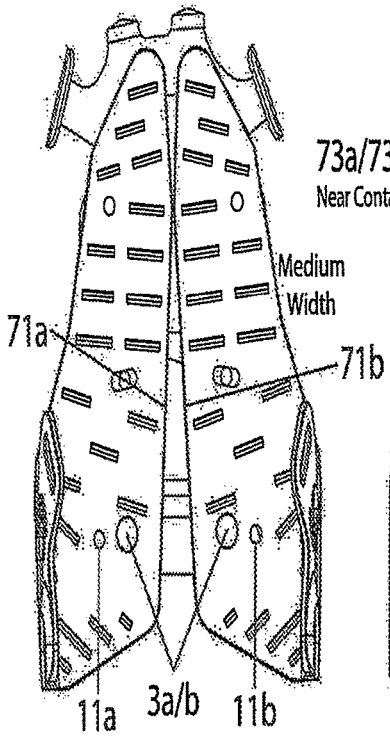
FIG. 6 is a top view of traction component in position 2 with straps and buckles removed for clarity, in accordance with various embodiments.
Figure 8:
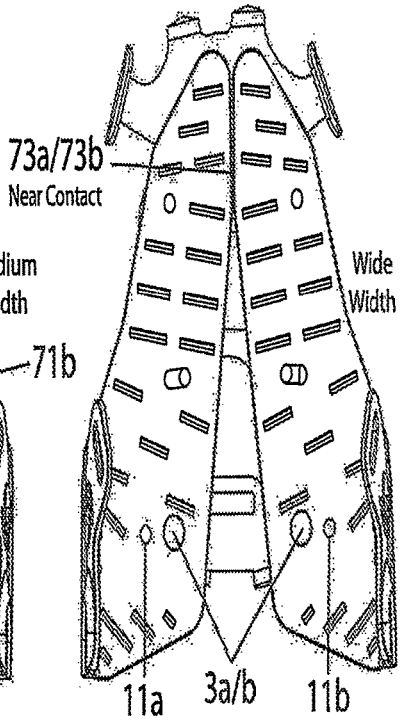
FIG. 8 is a top view of traction component in position 3 with straps and buckles removed for clarity, in accordance with various embodiments.
Figure 5:
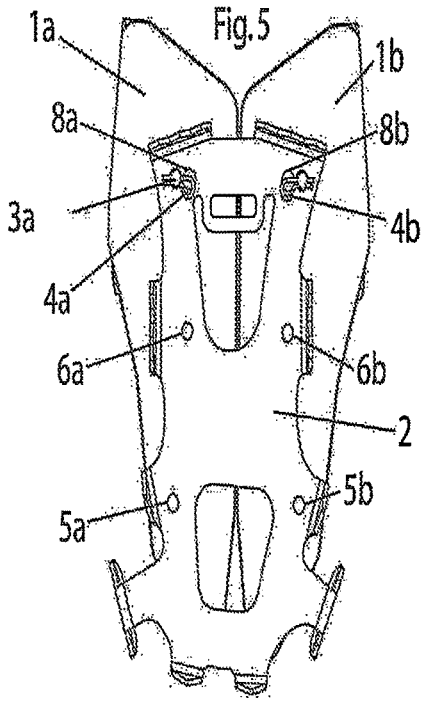
FIG. 5 is a bottom view of traction component in position 1 with straps and buckles removed for clarity, in accordance with various embodiments.
Figure 7:
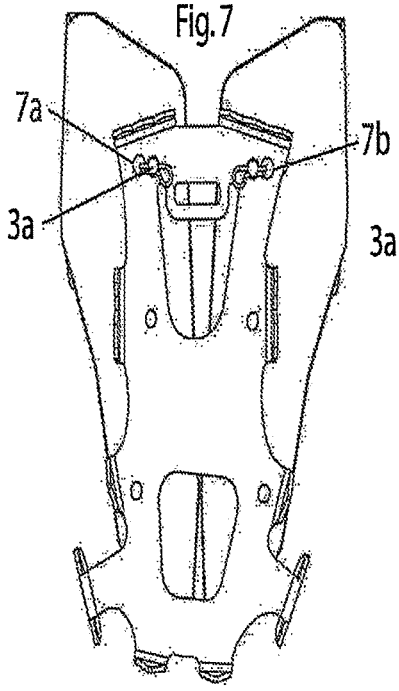
FIG. 7 is a bottom view of traction component in position 2 with straps and buckles removed for clarity, in accordance with various embodiments.
Figure 9:
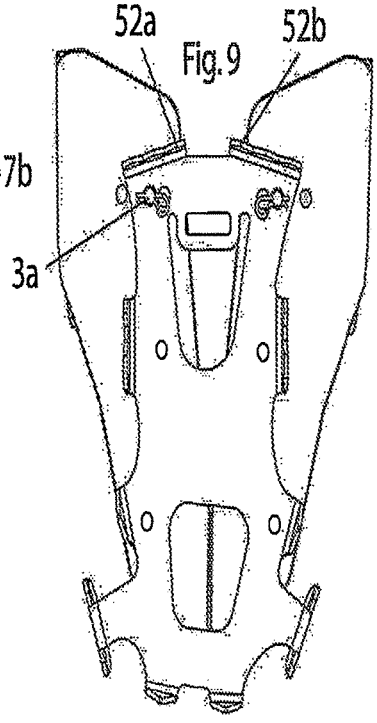
FIG. 9 is a bottom view of traction component in position 3 with straps and buckles removed for clarity, in accordance with various embodiments.
Figure 10:
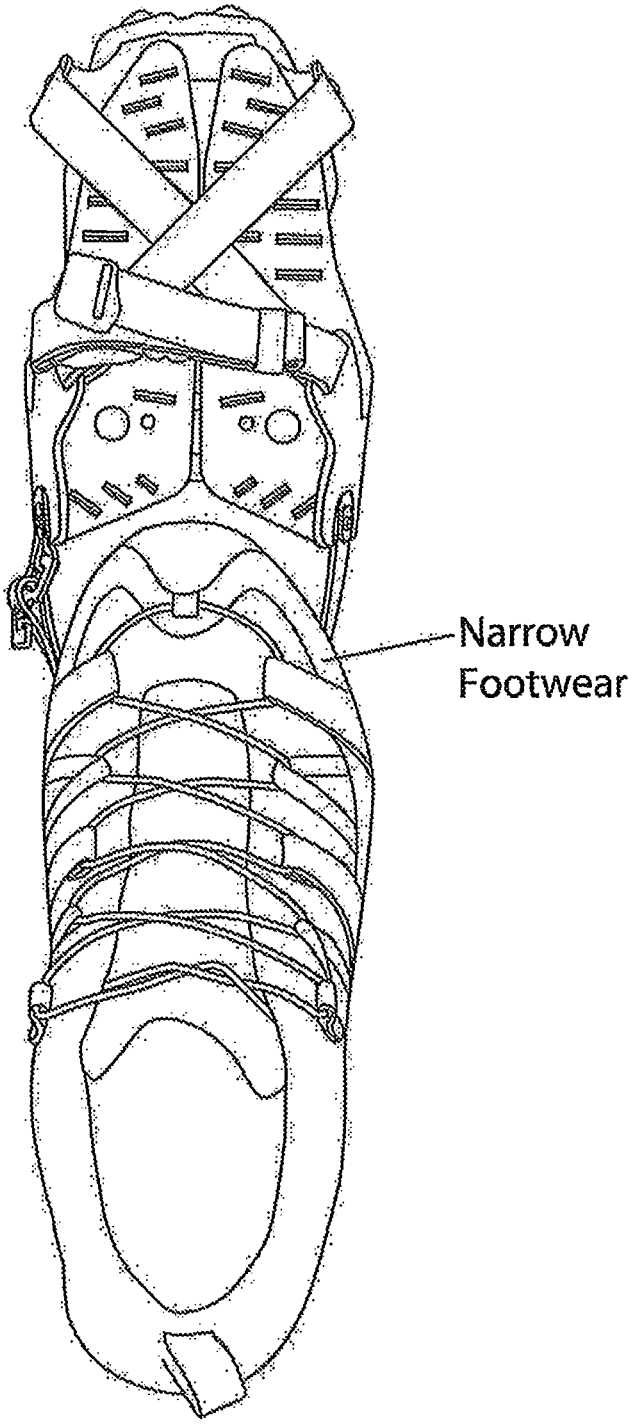
FIG. 10 is a top view of a traction component in position 1 shown with properly sized narrow footwear, in accordance with various embodiments.
Figure 11:
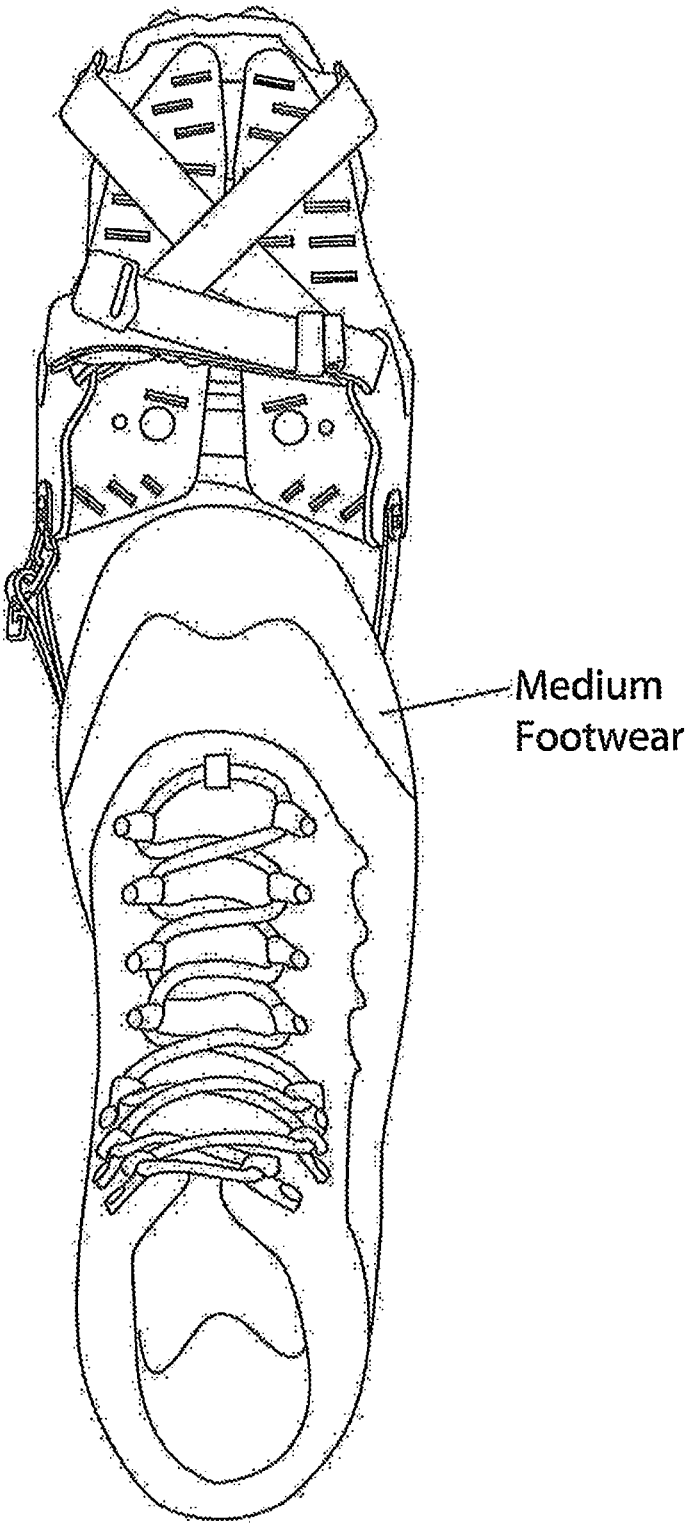
FIG. 11 is a top view of a traction component in position 2 shown with properly sized regular footwear, in accordance with various embodiments.
Figure 12:
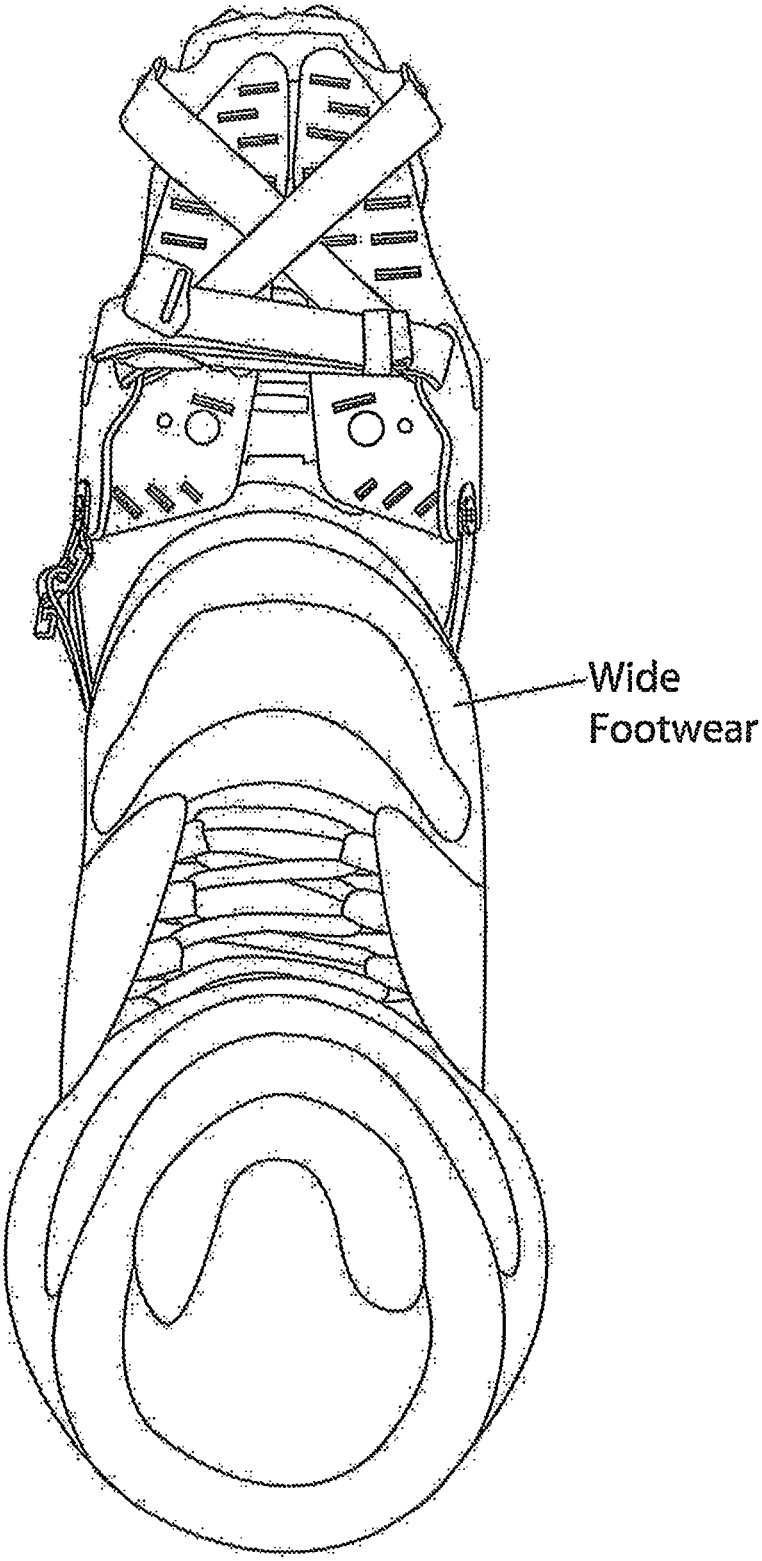
FIG. 12 is a top view of a traction component in position 3 shown with properly sized wide footwear, in accordance with various embodiments.

In various embodiments, as illustrated for example in FIGS. 4, 6, and 8 adjustable support 1*a* and adjustable support 1*b* can have an inner edge 71*a* and 71*b* respectively. In accordance with various embodiments, adjustable support 1*a* and adjustable support 1*b* can be located with adjustable support inner edge 71*a* substantially facing adjustable support inner edge 71*b*. For example, inner edge 71*a* and inner edge 71*b* can be located near but on opposite sides of the centerline of the top surface of base plate 2. In various examples, inner edge 71*a* and inner edge 71*b* can be located near the center of the distances between attachment points (either pivotable, slideable, or releasable) on base plate 2, but on opposite sides of the the center of the distances between attachment points (either pivotable, slideable, or releasable).

In accordance with various embodiments, inner edge 71*a* and inner edge 71*b* can be configured to contact or nearly contact along a first plane 72*a* and 72*b* respectively in response to the first adjustable support 1*a* and the second adjustable support 1*b* being located in their most separated (i.e. widest) position relative to one another. Inner edges 71*a* and 71*b* can be configured to contact or nearly contact along a second plane 73*a* and 73*b* respectively in response to the first adjustable support 1*a* and the second adjustable support 1*b* being located in their closest (i.e. narrowest) position relative to one another.

In various embodiments, first plane 72*a* and first plane 72*b* can separate from one another as adjustable support 1*a* and adjustable support 1*b* rotate relative to the base plate adapting to fit a narrower footwear. Conversely, first plane 72*a* and first plane 72*b* can approach one another as adjustable support 1*a* and adjustable support 1*b* rotate relative to the base plate adapting to fit a wider footwear. In various embodiments, second plane 73*a* and second plane 73*b* can separate from one another as adjustable support 1*a* and adjustable support 1*b* rotate relative to the base plate adapting to fit a wider footwear. Conversely, second plane 73*a* and second plane 73*b* can approach one another as adjustable support 1*a* and adjustable support 1*b* rotate relative to the base plate adapting to fit a narrower footwear.

In various embodiments, inner edges 71*a* and 71*b* can be located such that that inner edges 71*a* and 71*b* touch or nearly teach at one or more locations. In various examples, inner edges 71*a* and 71*b* can continuously touch or continuously nearly touch at the transition between the first plane 72*a*/72*b* and the second plane 73*a*/73*b*. In various examples, 71*a* and 71*b* can touch along first plane 72*a*/72*b*, such as for example, in response to the widest adaptation of the adjustable supports 1*a*/1*b*. In various examples, 71*a* and 71*b* can touch nearly touch along second plane 73*a*/73*b*, such as for example, in response to the narrowest adaptation of the adjustable supports 1*a*/1*b*.

In accordance with various embodiments, base plate 2 can be attached to adjustable support 1*a* and 1*b* by fasteners. The fasteners that connect the base plate 2 to the adjustable support 1*a* and 1*b* can include rotatable fasteners 20*a* and 20*b* and slideable fasteners 21*a*, and 21*b*. As discussed above, the fasteners can be any fastener such as for example permanent rivets. Base plate 2 can also be selectively connected to adjustable support 1*a* and 1*b* by releasable pin 3 which is secured in place with removable clip 4. Rivets 20*a* and 20*b* can connect adjustable support 1*a* and 1*b* to base plate 2 through holes 9*a* and 9*b* in the horizontal foot bed of adjustable support 1*a* and 1*b* and hole 5*a* and 5*b* in the base plate 2. These rivets, 20*a* and 20*b*, act as pivot points for the adjustable support 1*a* and 1*b* such that the adjustable supports 17*a* and 17*b* can rotate to make an adjustment to the effective width of the overall footwear platform in order to accommodate a narrow (FIG. 10), regular (FIG. 11) or wide (FIG. 12) item of footwear. The adjustable supports 17*a* and 17*b* can also provide lateral support to the footwear. Removable pin 3*a* and/or pin 3*b* and are assembled through holes 11*a* or 12*a* and 11*b* or 12*b*, respectively, in the adjustable support 1*a* and 1*b* then through the properly aligned holes 7*a* or 8*a* and 7*b* or 8*b* in the base plate 2 to provide for various settings. In various embodiments, pin 3*a* can secure adjustable support 1*a* to base plate 2. In various embodiments, pin 3*b* can secure adjustable support 1*b* to base plate 2. Clip 4*a* and clip 4*b* can secure pin 3*a* and pin 3*b* from withdrawal respectively.

In accordance with an exemplary embodiment, as illustrated in FIGS. 2-7, there can be two-four positions which can be easily achieved by various assembled configurations. The positions which maintain a symmetrical width can be achieved by matching certain holes in base plate 2. In accordance with various examples, the following holes of the base plate 2 and adjustable supports 1*a* and 1*b* illustrate exemplary footwear positions:

- Position 0 can be very narrow configured as 11*a* with 8*a* and 11*b* with 8*b*. (Not shown as inner edge profile of the adjustable supports would need to be modified from illustrated examples.)
- Position 1 can be narrow configured as 11*a* with 7*a* and 11*b* with 7*b*. (see FIGS. 4, 5, and 10)
- Position 2 can be medium configured as 12*a* with 8*a* and 12*b* with 8*b*. (see FIGS. 6, 7, and 11)
- Position 3 can be wide configured as 12*a* with 7*a* and 12*b* with 7*b*. (see FIGS. 8, 9 and 12)

In accordance with the various embodiments, it is not required to maintain a symmetrical adjustment between adjustable supports 1*a* and 1*b* as outlined above. As such one adjustable support can be moved without moving the other adjustable support in the same or similar manner. However, it can be generally preferable to maintain symmetrical adjustment.

In accordance with the various embodiments, fasteners 21*a* and 21*b* can be assembled through holes 6*a* and 6*b*, respectively, and through intermediate slideable attachments 10*a* and 10*b* in the adjustable supports 1*a* and 1*b*, respectively. Intermediate slideable attachments 10*a* and 10*b* can be slots formed in the adjustable supports 1*a* and/or 1*b*. The fasteners 21*a* and 21*b* can be set in such a way that the fastener is not extremely compressed in order to allow the necessary movement of the adjustable support 1*a* and 1*b* relative to the base plate 2 while still providing the proper structural integrity to hold the components together while in use.

In accordance with the various embodiments, assembling six fasteners connecting the base plate 2 to the adjustable supports 1*a* and 1*b* creates traction component 22 which is then combined with front straps 25 and 26, front buckle 27, strap slide 28, strap end 29, and elastic strap keeper 37 (see e.g. exemplary FIG. 29) to provide an adjustable front binding for the front of traction component 22. All assembled together this comprises traction assembly 36.

Figure 17:
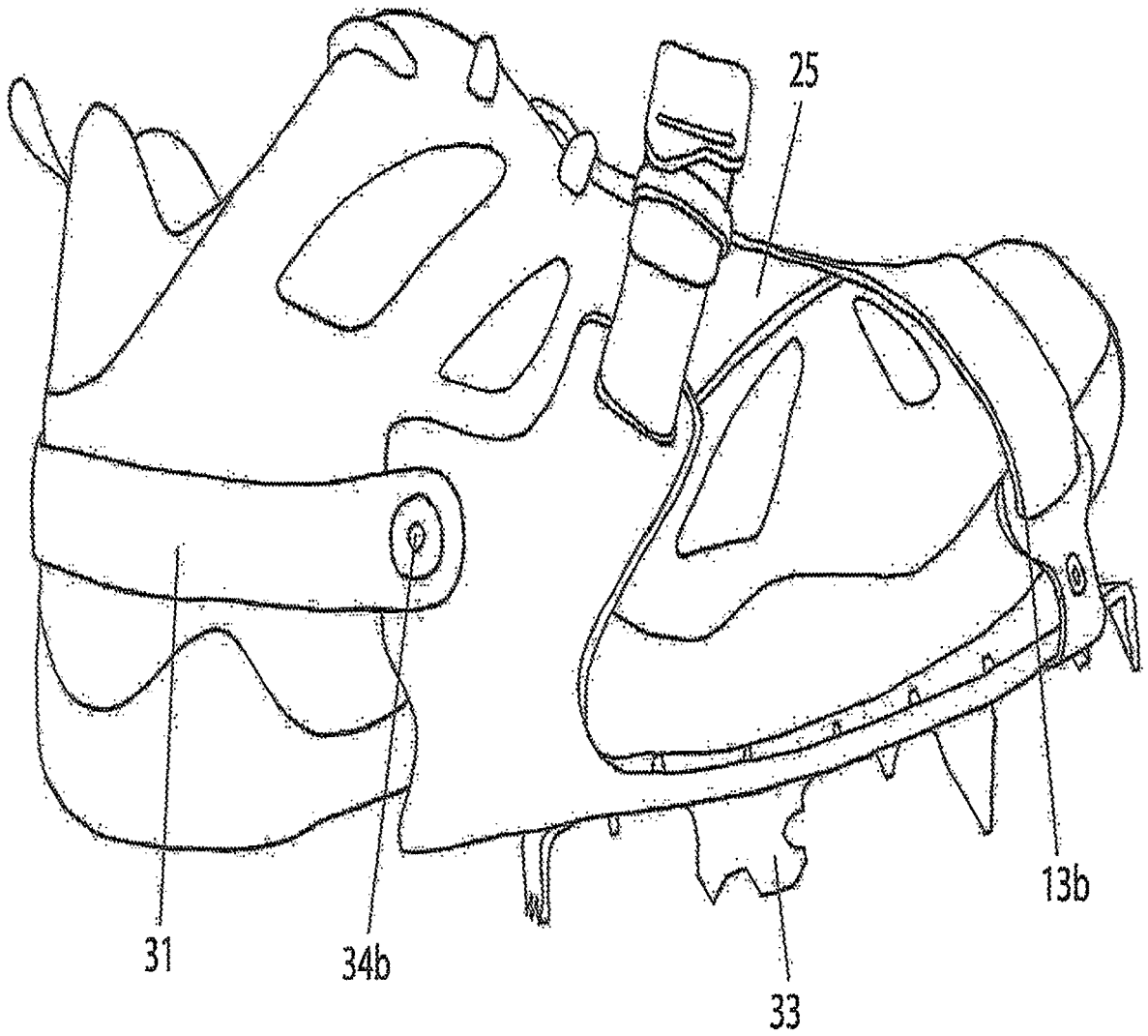
FIG. 17 is a side view of traction component fitted to a narrow shoe, in accordance with various embodiments.

In accordance with the various embodiments, as shown in exemplary FIG. 17, an elastomeric front binding rear strap 31 can be assembled onto the lateral support 17*b* by fixing the front binding rear strap 31 with anchor 34*b* in anchor receiving hole 18*b* (as shown in FIG. 1). As shown in exemplary FIG. 27, front binding rear strap 31 can then be threaded through a rear buckle 30. Buckle 30 can comprise a frame defining a slotted hole 40 on a first end and a restraining arm 38 on a second end of buckle 30, an opening between one end of the restraining arm 38 and the frame, and a tooth 39 (e.g., a rigid protrusion) or a plurality of teeth 39 extending from the frame generally toward the second end or any direction suitable to engage strap 31. Rear strap 31 can be threaded through slot 40 on buckle 30. Rear strap 31 can then proceed back, approximately at a 180 degree turn, over tooth 39. Tooth 39 can engage rear strap hole 41. Rear strap 31 can be secured under restraining arm 38. Since opening is open on one side, side access is available and the rear strap 31 can slide into the opening from the side. In various examples, rear strap 31 can still be threaded into an opening, closed on a side, similar to the slotted hole 40. Front binding rear strap 31 is then able to be tightened securely by simply pulling the end rearward and selecting which rear strap hole 41 to engage over tooth 39. To release the rear buckle 30 simply pull the strap upward to remove it from under the restraining arm 38 and then outward to disengage the rear strap hole 41 from tooth 39 which releases the strap tension and allows the wearer to remove the traction assembly 36 from the wearer's footwear. Excess material from rear strap 31 can be tucked into strap keeper 32. Strap keeper 32 can be a clip configured to attach to the strap closest to the footwear and retain excess rear strap 32. Strap keeper 32 can comprise a restraining arm as well.

Figure 18:
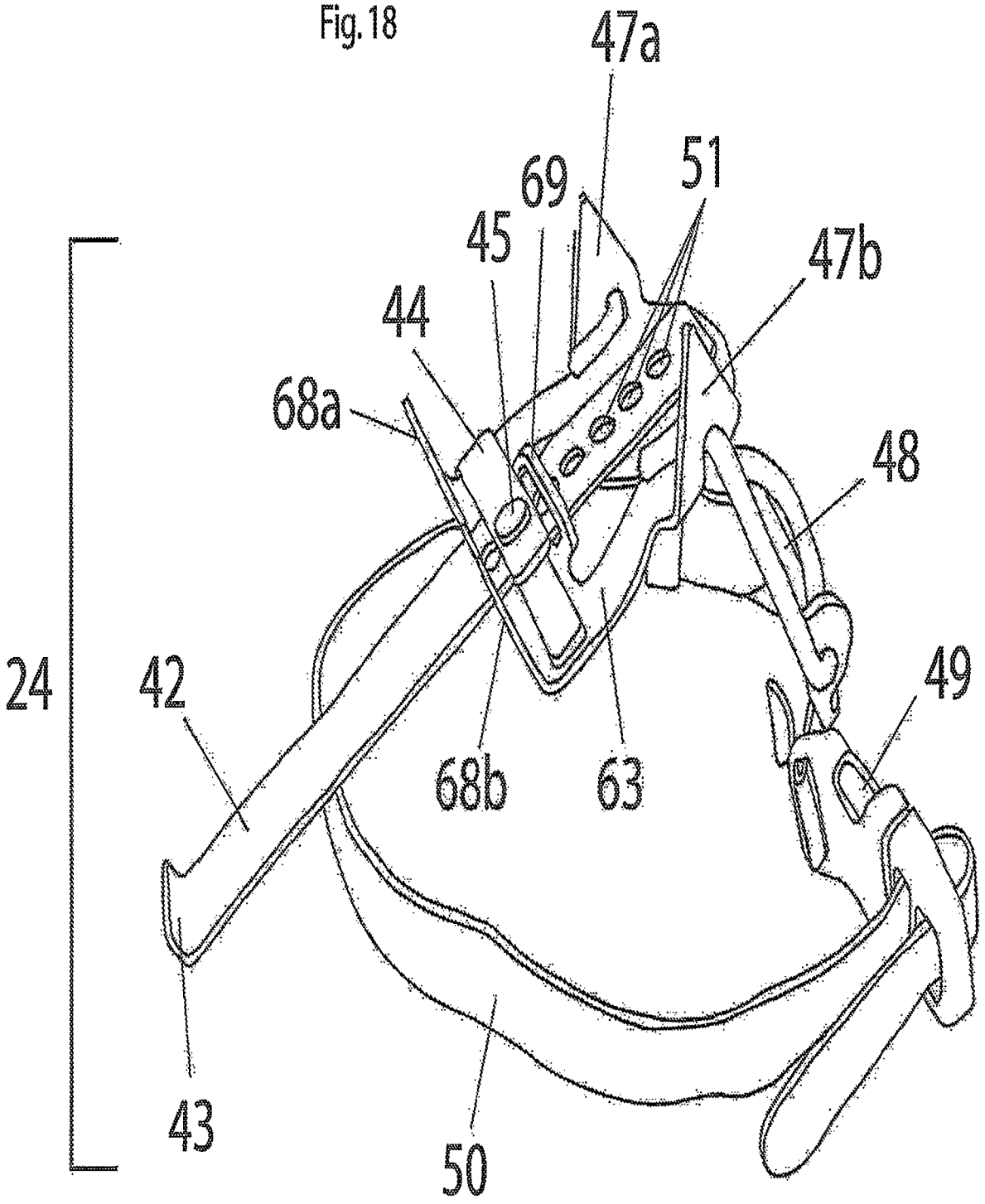
FIG. 18 is an isometric view of a removable rear traction component, in accordance with various embodiments.

In accordance with the various embodiments, as shown in the exemplary FIG. 18, a rear traction unit 24 can comprise a rear base plate 63 and a rear upright support 48. Rear base plate 63 can comprise adjuster bar slot 69. Rear base plate 63 can comprise a plurality of cleats such as cleats 47*a*, 47*b*, 68*a*, and 68*b*. The rear upright support 48 can comprise rear binding strap 50 having a releasable buckle 49.

Figure 19:
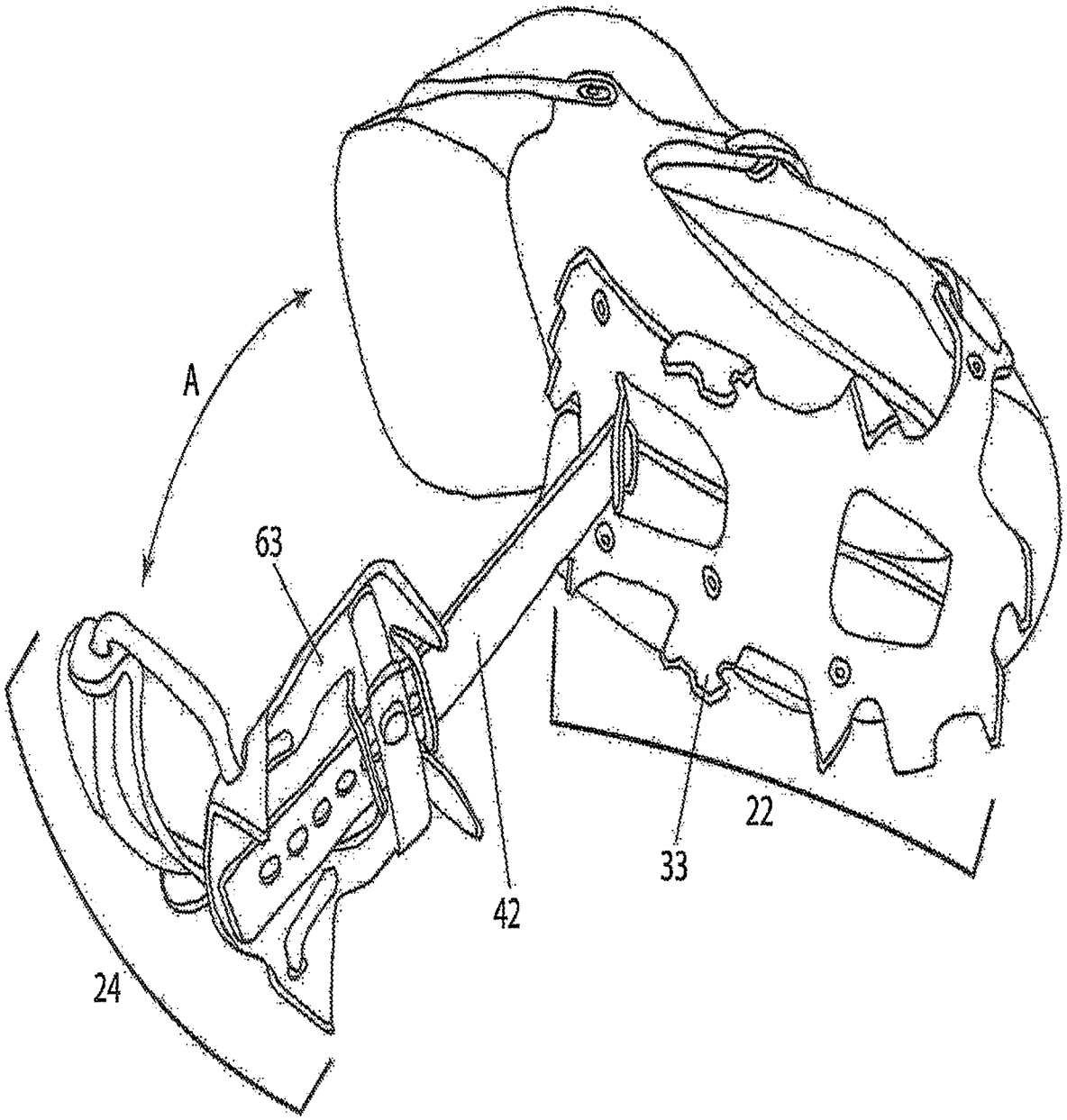
FIG. 19 is an isometric view of a removable rear traction component being engaged with front traction component, in accordance with various embodiments.
Figure 20:
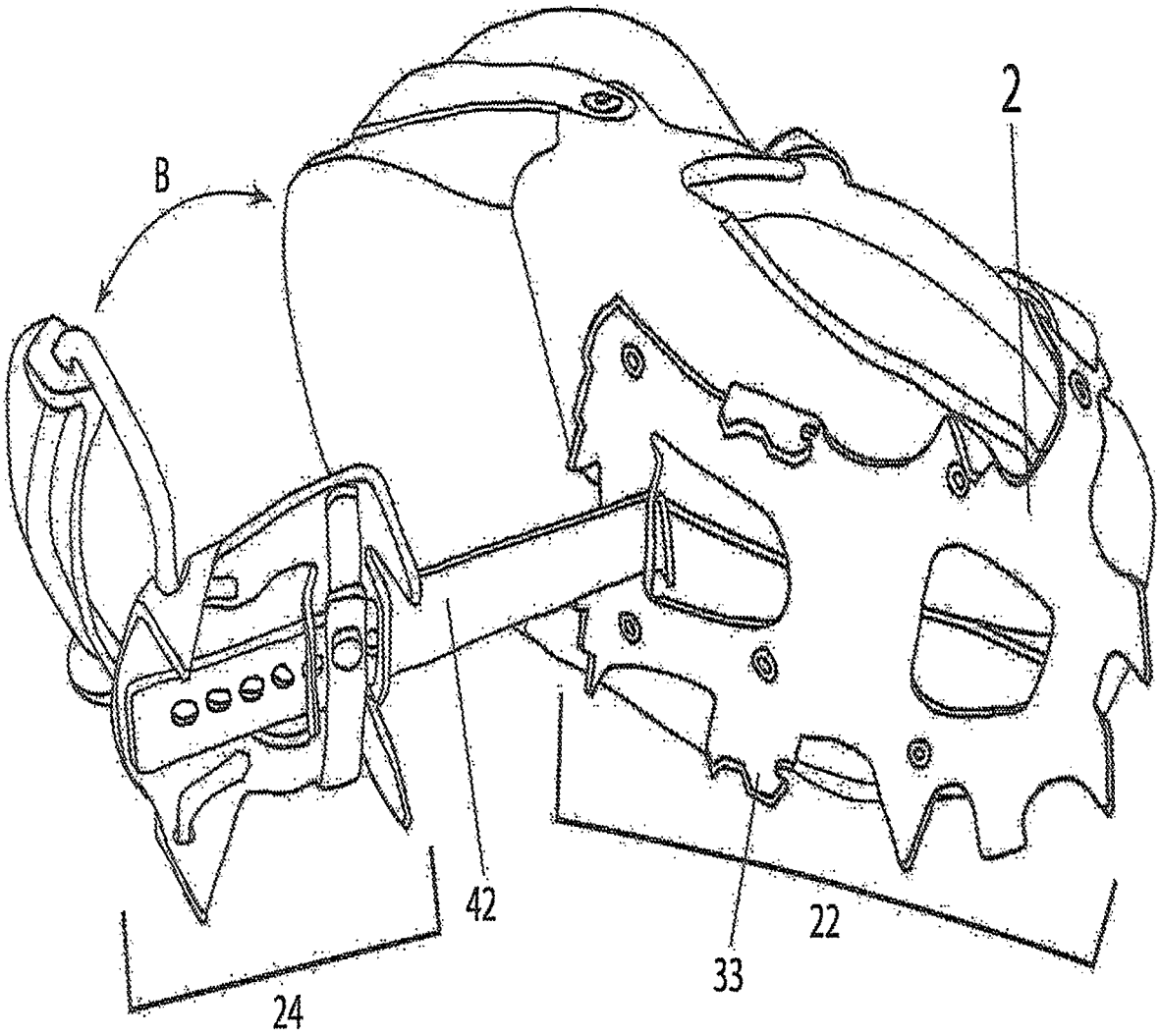
FIG. 20 is an isometric view of a removable rear traction component being engaged with front traction component and moved into place, in accordance with various embodiments.
Figure 21:
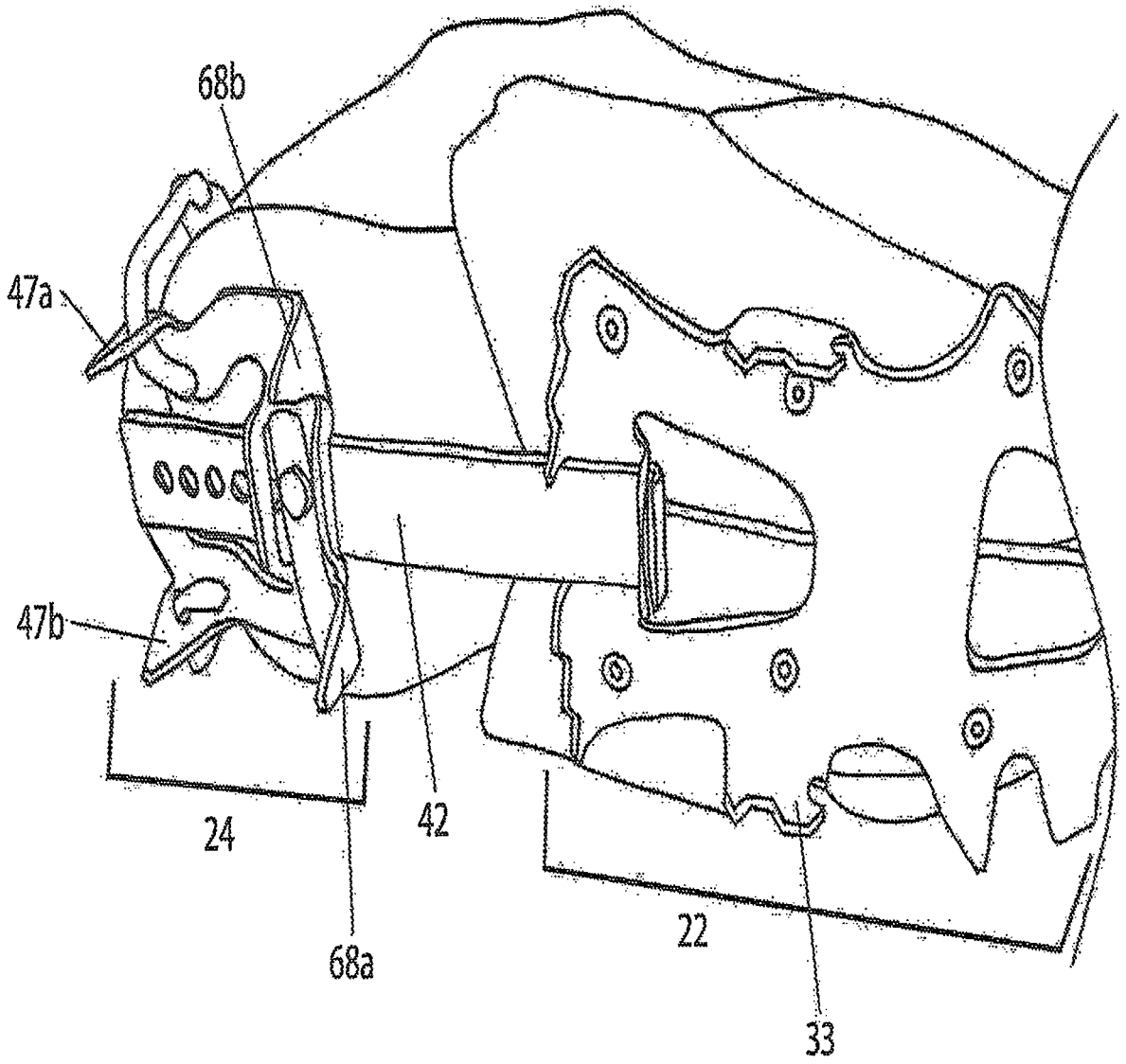
FIG. 21 is an isometric view of a removable rear traction component fully engaged with front traction component, in accordance with various embodiments.
Figure 22:
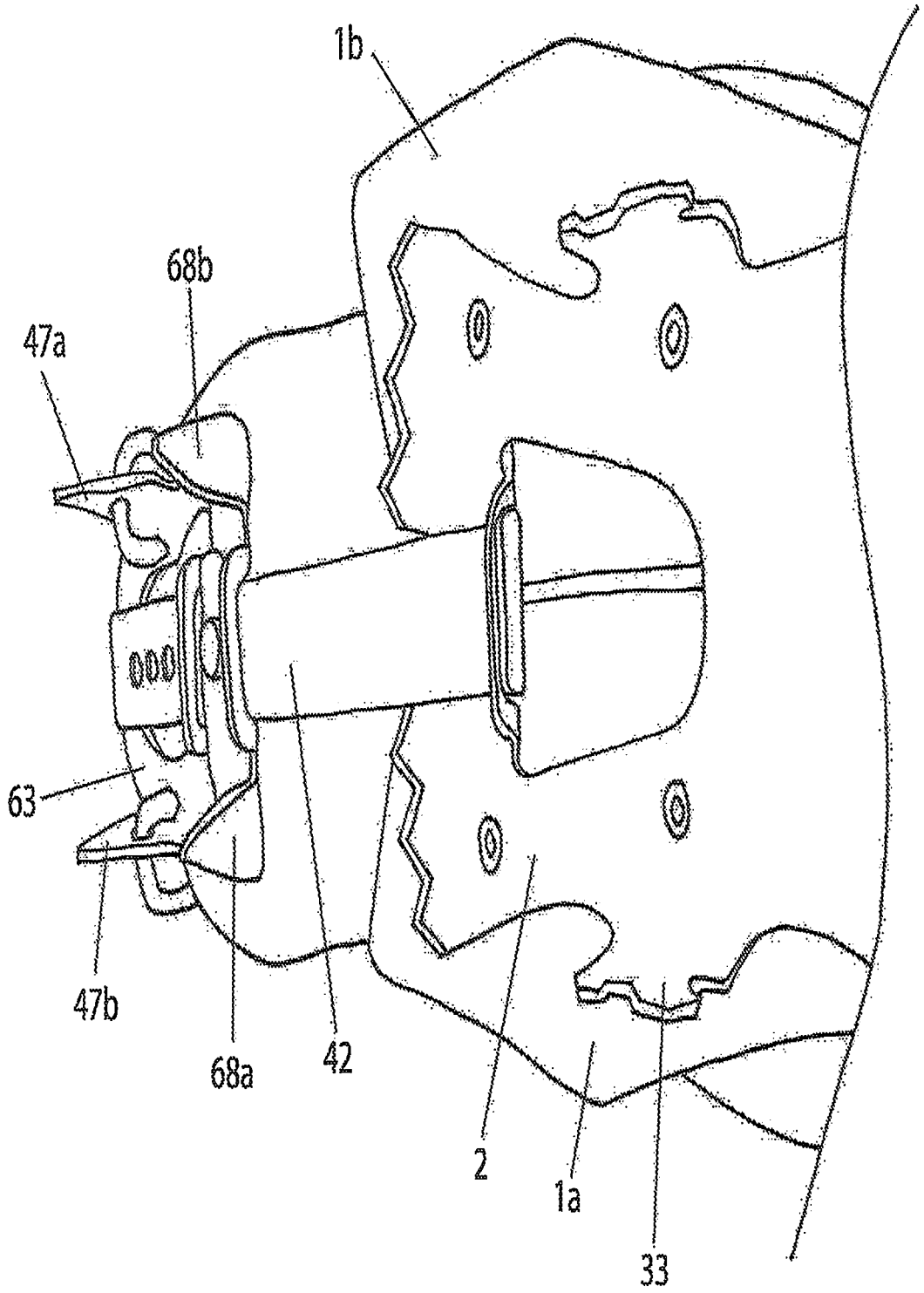
FIG. 22 is a bottom front view of front traction component with fully engaged removable traction component, in accordance with various embodiments.
Figure 23:
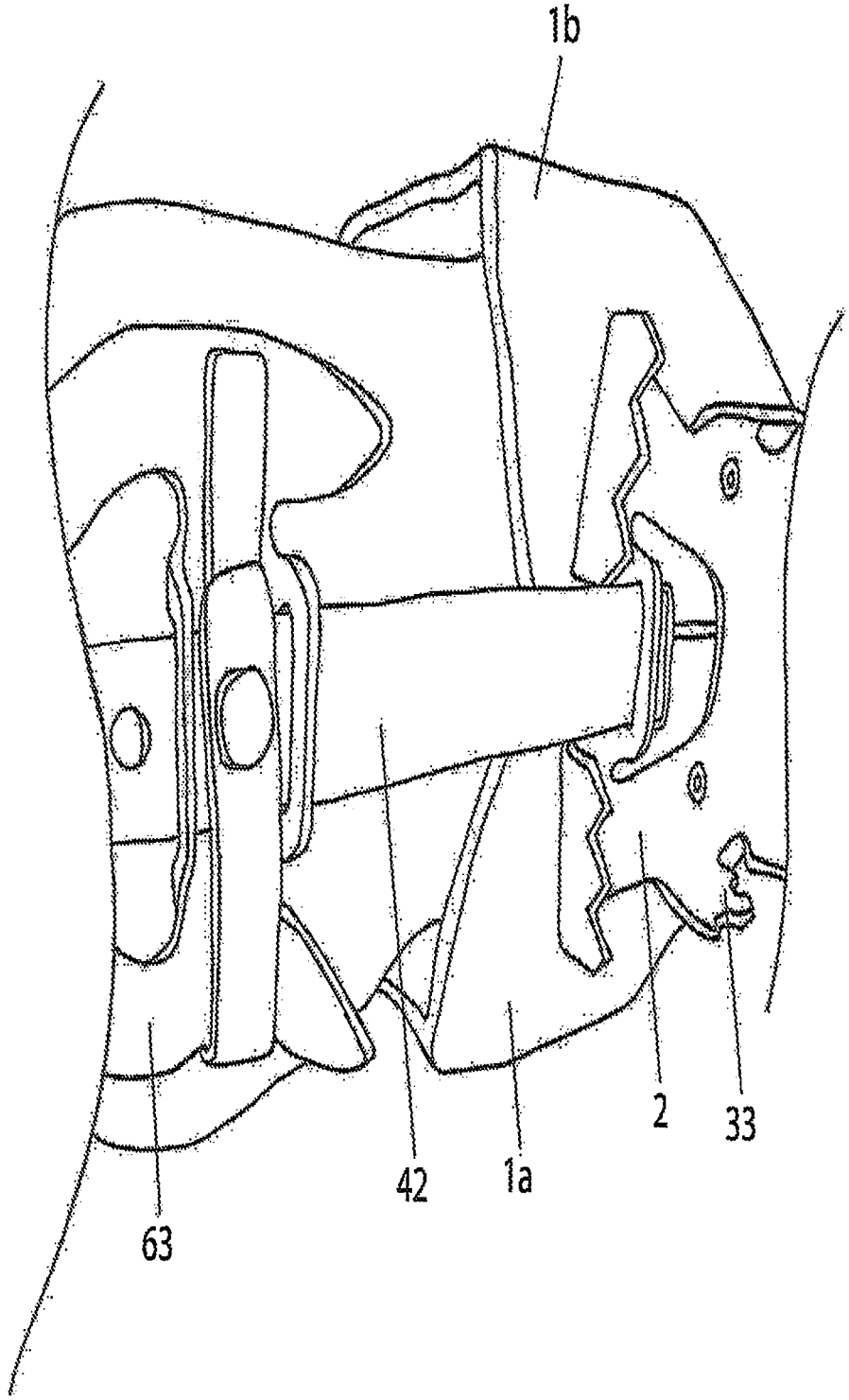
FIG. 23 is a bottom rear view of front traction component with fully engaged removable traction component, in accordance with various embodiments.
Figure 24:
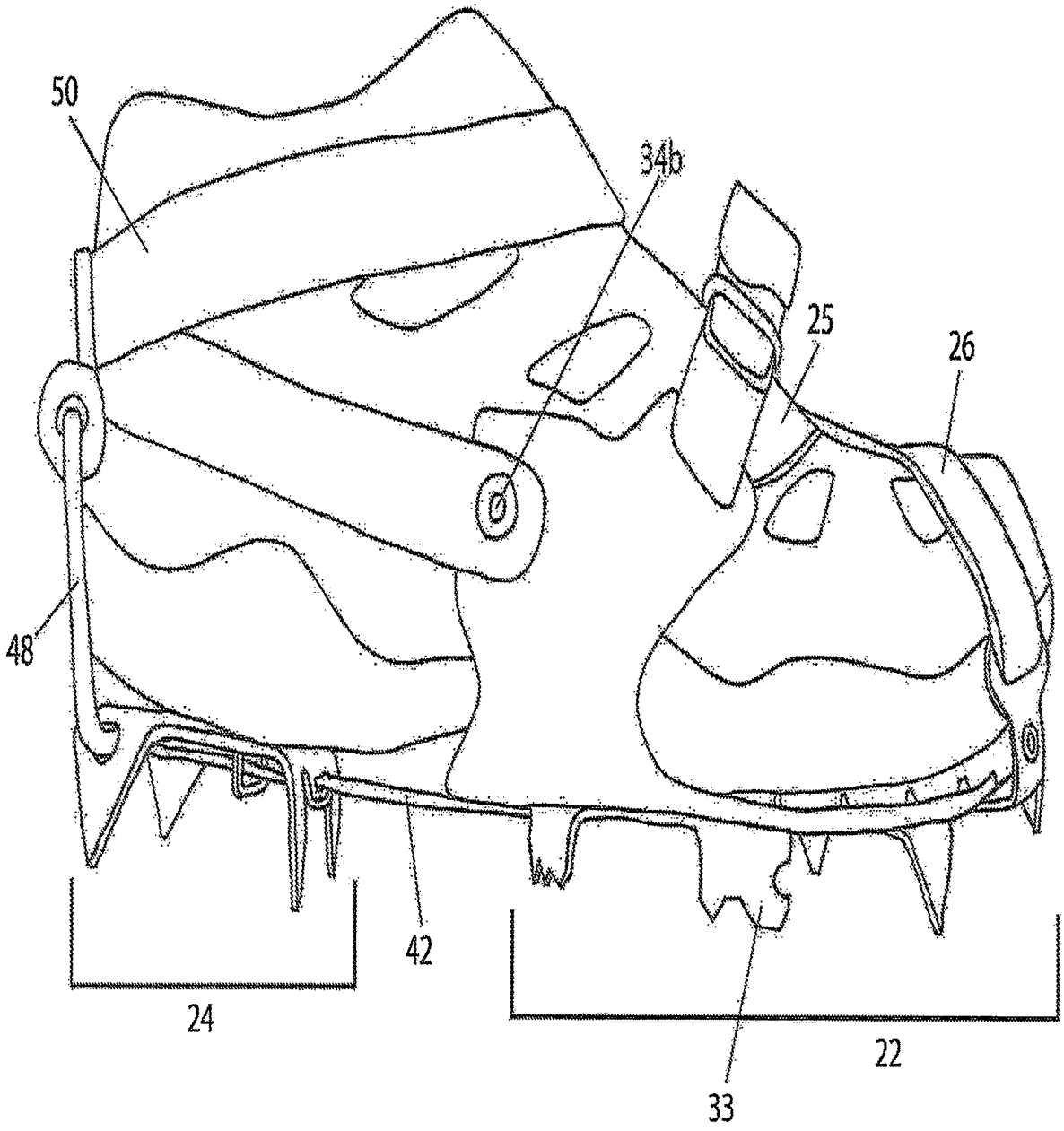
FIG. 24 is a side view of front traction component with removable traction component fully engaged, in accordance with various embodiments.
Figure 25:
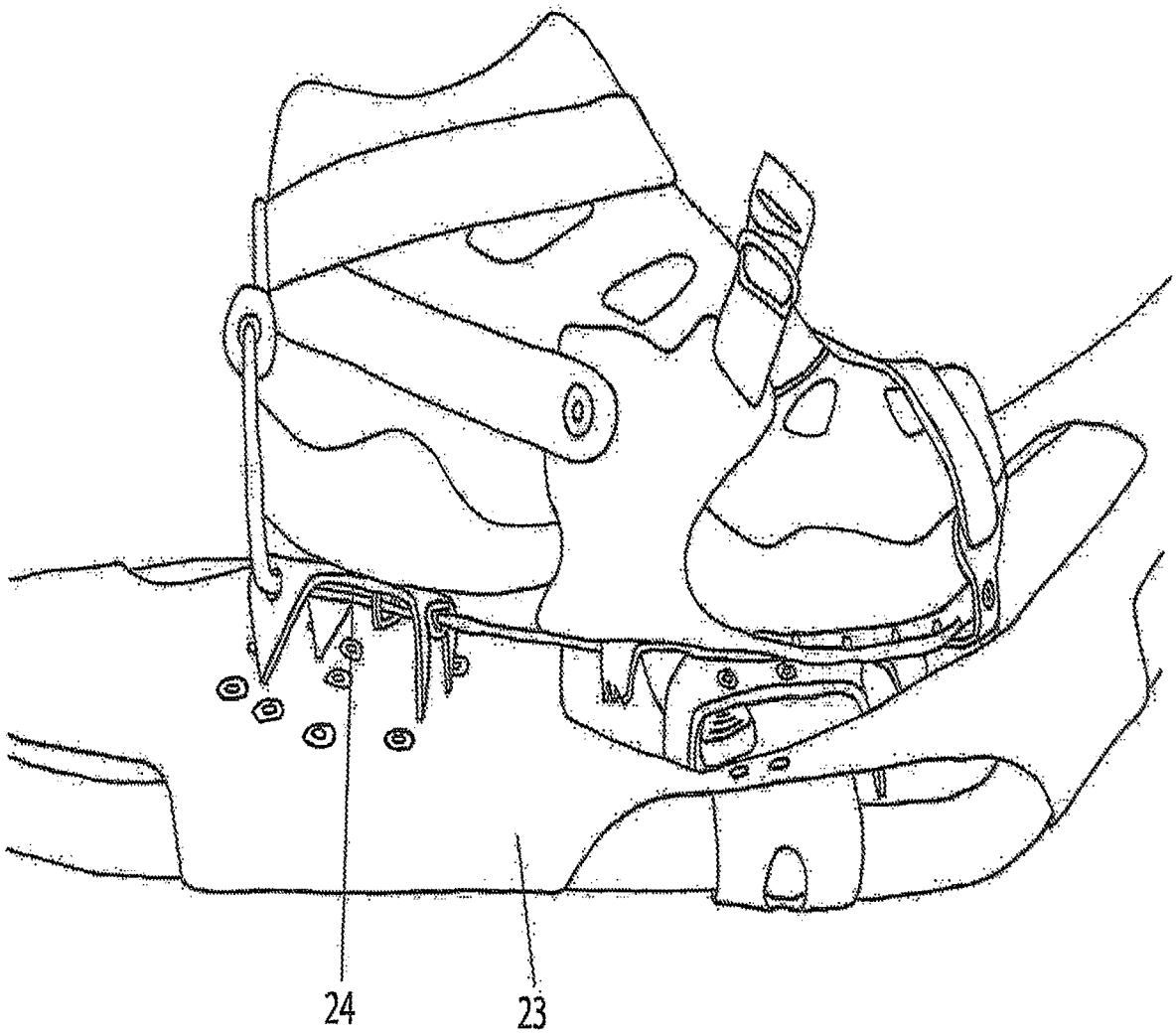
FIG. 25 is a side view of front traction component with heel component engaged and also engaged to snowshoe platform, in accordance with various embodiments.
Figure 26:
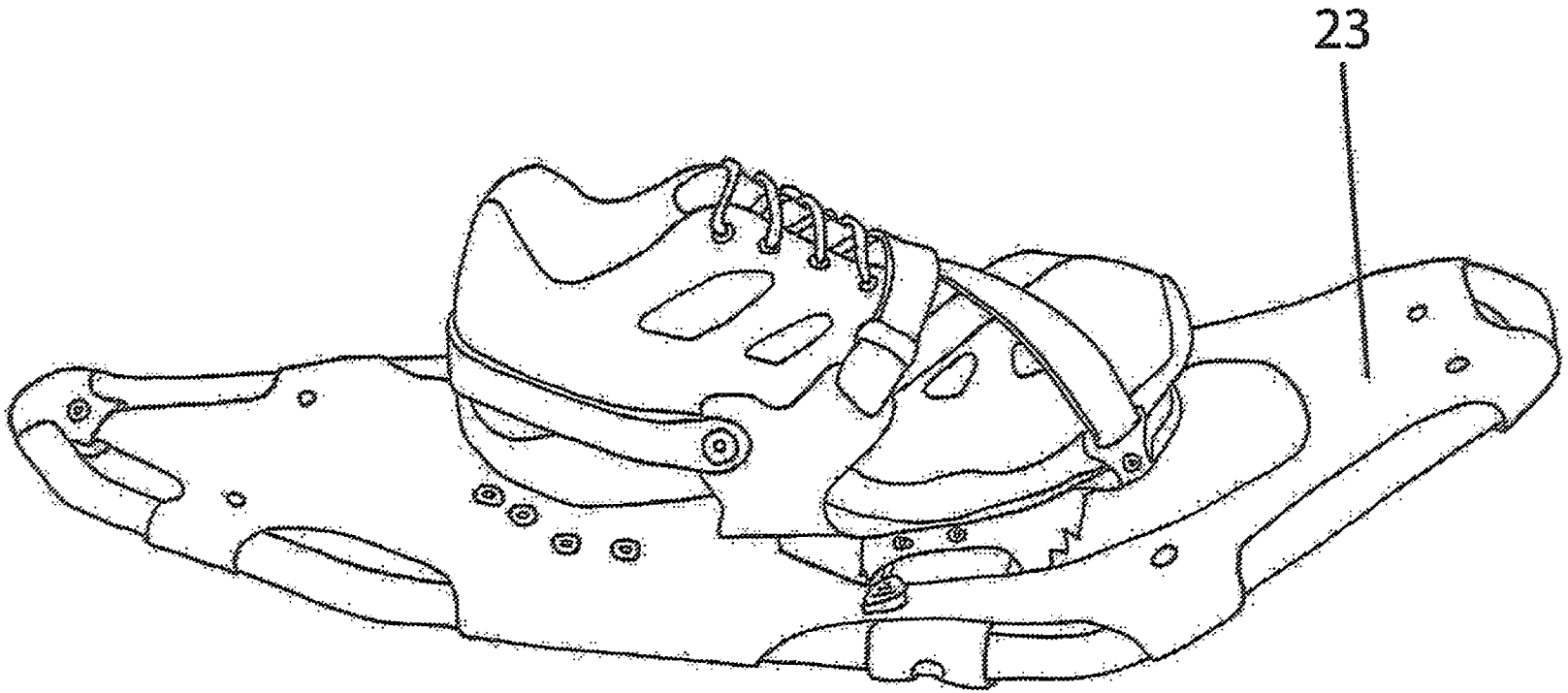
FIG. 26 is an isometric side view of front traction component engaged to snowshoe platform, in accordance with various embodiments.

In accordance with the various embodiments, removable rear traction unit 24 can be selectively connected to traction component 22 by engaging the hook like tab 43 on an adjustable length extender bar 42 with the slot 54 created by the bent tab 51. The rear traction component 24 can then be rotated along with the extender bar 42 into place against the outsole of the footwear. For example FIG. 19 shows rotation A and FIG. 20 shows the shortened rotation B. Illustrative FIGS. 21-25 shows the rear traction unit 24, adjustable length extender bar 42, and front traction unit 22 secured to the bottom of footwear. The rear binding strap 50 with releasable buckle 49 can be fastened around the wearer's ankle or portion of the upper foot. Extender bar 42 is then bound by stabilizing elements 52*a* and 52*b* such that the extender bar 42 is not able to move laterally to any significant degree. Extender bar 42 can have a width approximately equal to the distance between stabilizing element 52*a* and stabilizing element 52*b*. A tight tolerance here limits the movement of the extender bar 42 between stabilizing elements 52*a* and 52*b*. Limiting the rear extender bar's movement allows the rear traction unit 24 to be secured into place better. However this structure provides for upward and downward flexing allowed by the flexible material comprising the extender bar 42.

In accordance with various embodiments, adjustable length extender bar 42 can be adjusted on rear traction unit 24. For example, adjustable length extender bar 42 can insert through adjuster bar slot 69 on rear base plate 63. An extender bar strap 44 can lay overtop adjustable length extender bar 42. In this position, adjustable length extender bar 42 is sandwiched between extender bar strap 44 and rear base plate 63. Fastener 45 can further retain adjustable length extender bar 42 between extender bar strap 44 and rear base plate 63.

In accordance with the various embodiments, this removable rear traction unit 24 is then easily added to and removed from the traction component 22 by the wearer without the need to remove traction component 22 from the wearer's footwear. For example, when utilizing the binding system with snow shoe 23, as shown in exemplary FIGS. 25-26, it can not be desirable to have the rear traction unit 24 attached as it could damage the snow shoe as shown in exemplary FIG. 25. As such, it can be desirable to remove the rear traction component 24 without removing the front traction component 22 as the system is configured to do.

In accordance with various embodiments, the current invention can be applied to many varieties of footwear accessories. A specific example is given in this application as it relates to a traction component 22 which is attached to the wearer's footwear for added traction while walking on snow and/or ice. In this case, the traction component 22 is also compatible with a snowshoe platform 23 by selectively engaging a step-in mechanism 33 to attach the traction component 22 to the snowshoe platform 23. Furthermore, this example includes a traction component 22 and removable rear traction unit 24 for use with the traction component 22 when full coverage of the outsole of the footwear with traction cleats is preferable.

In accordance with other embodiments, the binding system can comprise a structure in which the first support and the second support do not rotate around a fixed point. While such a system can be more complicated to use they can allow freedom of the first support and the second support in multiple directions (e.g. side to side and front to back relative to the base plate). For example, the binding system can be constructed with a base plate and a first and second support. The first and second supports can be attached to the base plate with four or more independent releasable fasteners which can be selectively fastened into different holes. A plurality of holes can be located in the first support, the second support, and/or the base plate. The holes can be aligned such that movement of the first support and or the second support relative to the base plate maintains alignment of different holes relative to one another. Thus, moving the first support and the second support together or apart relative to the base plate allows for multiple positions to accommodate different widths of footwear.

Benefits, other advantages, and solutions to problems have been described herein with regard to specific embodiments. However, the benefits, advantages, solutions to problems, and any elements that can cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone can be present in an embodiment, B alone can be present in an embodiment, C alone can be present in an embodiment, or that any combination of the elements A, B and C can be present in a single embodiment; for example, A and B, A and C, B and C, or A and B and C. All structural, chemical, and functional equivalents to the elements of the above-described exemplary embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but can include other elements not expressly listed or inherent to such process, method, article, or apparatus.

The invention claimed is:

1. A crampon system adaptable to different widths of footwear, wherein the crampon system comprises: a metal base plate having a substantially rigid horizontal platform; a first adjustable, polymeric support having a substantially horizontal platform, wherein the first adjustable support is less rigid than the base plate; and a second adjustable, polymeric support having a substantially horizontal platform, wherein the first adjustable support is less rigid than the base plate, wherein the base plate and the first adjustable support are rotatably connected, wherein the base plate and the second adjustable support are rotatably connected, wherein the base plate and the first adjustable support are releasably connected, wherein the base plate and the second adjustable support are releasably connected, wherein the first adjustable support or the second adjustable support are able to move relative to the base plate upon release of a fastener, wherein the substantially horizontal platform of the first adjustable support and the substantially horizontal platform of the second adjustable support are in the substantially the same plane, wherein the first adjustable support and second adjustable support are rotatably connected to the base plate at different locations, wherein the crampon system is configured such that the substantially rigid horizontal platform extends from a toe box anterior end to a midfoot of a footwear during use and the substantially horizontal platforms of the first and second adjustable supports extend from the toe box anterior end to the midfoot of the footwear, are located between the substantially rigid horizontal platform and the footwear during use, and do not overlap each other.

2. The crampon system of claim 1, wherein the first adjustable support and the second adjustable support includes a sidewall extending upwardly from the rigid horizontal platform of the first adjustable support and the second adjustable support, respectively, wherein the sidewalls are configured to contact sides of the footwear, wherein the sidewalls are spaced apart a distance, wherein as the first adjustable support or the second adjustable support are moved relative to the base plate, the distance between the sidewalls changes.

3. The crampon system of claim 2, wherein the sidewall of the first adjustable support and the sidewall of the second adjustable support have a plurality of protrusions which are configured to contact a side of the footwear upper and restrict movement of the footwear.

4. The crampon system of claim 2, wherein the base plate and the first adjustable support are connected at a slideable attachment located within a region on the first adjustable support intermediate to a rotatable connection and a releasable connection, wherein the slideable attachment is configured to restrict the range of rotation of the first adjustable support and wherein system is configured such that during use, the releasable connection is nearer the toe of the footwear than the rotatable connection is near the toe of the footwear.

5. The crampon system of claim 1, wherein at least one of the first adjustable support and the second adjustable support comprise a plurality of fastening points, allowing selective adjustment between the base plate and at least one of the first adjustable support and the second adjustable support.

6. The crampon system of claim 1, wherein the base plate further comprises a front support extending upwardly from a forward portion of the base plate, wherein the front support participates in securing the front of the footwear, wherein a plurality of teeth protrude from the bottom side of the base plate.

7. The crampon system of claim 1, further comprising:

a rear binding that is releasably connected to a front binding comprising the base plate, the first adjustable support and the second adjustable support, wherein the front binding is adapted to remain securely attached to the footwear when the rear binding is detached from the front binding and the footwear and wherein the base plate comprises cleats.

8. The crampon system of claim 7, wherein the base plate comprises two stabilizing elements spaced apart a distance and wherein the rear binding comprises:

a rear base plate comprises cleats;

an adjustable length extender bar having a width approximately equal to the distance between the two stabilizing elements;

the adjustable length extender bar being releasably fastenable to the base plate of the front binding and extendable between the two stabilizing elements of the base plate of the front binding;

a rear lateral support; and a rear strap having a releasable buckle, wherein the rear strap and the releasable buckle are configured to restrain the footwear to the rear binding.

9. The crampon system of claim 1, wherein a front binding comprising the base plate, the first adjustable support, and the second adjustable support is configured to couple with a snow shoe.

10. The crampon system of claim 9, wherein the base plate comprises cleats.

11. A crampon system adapted for use with footwear comprising: a base plate comprised of a substantially rigid, metallic material and in a substantially horizontal plane; at least two adjustable polymeric supports comprising a substantially horizontal platform and lateral supports coupled to the horizontal platform and configured to contact a lateral side of the footwear upper during use, wherein the at least two adjustable polymeric supports are less rigid than the base plate; wherein a bottom side of the at least two adjustable supports are in direct contact with a top side of the base plate, wherein each of the at least two adjustable supports are connected to the base plate by a plurality of attachments, wherein two of the plurality of attachments, one on each of the at least two adjustable supports, are connected to the base plate allowing for only rotational positional adjustment of the at least two adjustable supports relative to the base plate, wherein a second set of the plurality of attachments include multiple positions for engaging the base plate to the at least two adjustable supports with a releasable fastener, wherein the at least two adjustable supports extend from a toe box anterior end to the midfoot of the footwear during use and do not overlap with one another.

12. The crampon system of claim 11, wherein the at least two adjustable, polymeric supports have a plurality of protrusions extending from the substantially horizontal platforms and lateral supports, wherein the plurality of protrusions are configured to contact a bottom of the footwear and side of the footwear upper, respectively, and restrict movement of the footwear.

13. The crampon system of claim 11, wherein the base plate further comprises a front support extending upwardly from a forward portion of the base plate, wherein the front support is configured to secure the front of the footwear.

14. The crampon system of claim 11, wherein the front binding further comprises an adjustable strap buckle adapted to secure an adjustable strap having multiples holes therein, the buckle comprising:

a first closed end adapted to attach to an anchor, a second end which includes a side opening configured to allow adjustable strap to pass through the side opening;

a tooth element between the first and the second end, said tooth element projecting in a direction toward the second end, wherein the tooth is adapted to engage and secure one of the said multiple holes in the adjustable strap.

15. The crampon system of claim 11, wherein a third set of attachments of the plurality of attachments are intermediate slideable attachments configured to restrict the range of rotation of the at least two adjustable supports.

16. The crampon system of claim 11, wherein the second set of the plurality of attachments include multiple positions for engaging the base plate to the at least two adjustable supports with the releasable fastener by utilizing a plurality of fastening points, allowing position between the base plate and the at least two adjustable supports to be fixed in a plurality of positions relative to one another.

17. The crampon system of claim 11, further comprising:

a rear binding configured to extend between the midfoot and the heel of the footwear during use and that is releasably connected to a front binding comprising the base plate and the at least two adjustable supports, wherein the front binding is adapted to remain securely attached to the footwear when the rear binding is detached from the footwear.

18. The crampon system of claim 17, wherein the base plate comprises two stabilizing elements spaced apart a distance and wherein the rear binding comprises:

a rear base plate comprising cleats;

an adjustable length extender bar having a width approximately equal to the distance between the two stabilizing elements;

the adjustable length extender bar being releasably connected to the base plate of the front binding and extendable between the two stabilizing elements of the base plate of the front binding;

a rear lateral support; and a rear strap having a releasable buckle, wherein the rear strap and the releasable buckle are configured to restrain the footwear to the rear binding.

19. The crampon system of claim 2, wherein each of the sidewalls comprise two connecting members, one configured to couple to a first strap that can go over the top of the footwear and another configured to couple a second strap that can go around the heel of the footwear during use.

20. The crampon system of claim 1, wherein the base plate comprises first end configured to be disposed under the toe box during use, a posterior end configured to be disposed at a midline of a foot during use, and a portion intermediate to the first end and the second end configured to be disposed under the forefoot of the footwear at the midline of a foot during use.

* * * * *